US010948177B1

(12) United States Patent
Mowry et al.

(10) Patent No.: US 10,948,177 B1
(45) Date of Patent: Mar. 16, 2021

(54) LIGHT EMITTING FIRE KNIFE DEVICE

(71) Applicants: Amber Mowry, Midway, UT (US); Dace Mowry, Midway, UT (US)

(72) Inventors: Amber Mowry, Midway, UT (US); Dace Mowry, Midway, UT (US); Terrix Mowry, Midway, UT (US); Alex Mowry, Midway, UT (US)

( * ) Notice: Subject to any disclaimer, the term of this patent is extended or adjusted under 35 U.S.C. 154(b) by 0 days.

(21) Appl. No.: 16/727,734

(22) Filed: Dec. 26, 2019

Related U.S. Application Data

(60) Provisional application No. 62/785,827, filed on Dec. 28, 2018.

(51) Int. Cl.
*F41B 13/00* (2006.01)
*F21V 33/00* (2006.01)
(Continued)

(52) U.S. Cl.
CPC ..... *F21V 33/008* (2013.01); *A63H 33/009* (2013.01); *B26B 1/10* (2013.01); *F21S 9/02* (2013.01); *F21S 10/04* (2013.01); *F21V 23/003* (2013.01); *F21V 23/06* (2013.01); *F41B 13/00* (2013.01); *F41B 15/00* (2013.01); *A63H 33/00* (2013.01); *F21Y 2105/00* (2013.01); *F21Y 2115/10* (2016.08)

(58) Field of Classification Search
CPC ..... A63H 33/009; A63H 33/22; B26B 1/10; F21V 33/008; F41B 13/00; F41B 13/02; F41B 15/00
USPC ..... 446/473, 485
See application file for complete search history.

(56) References Cited

U.S. PATENT DOCUMENTS 4,678,450 A * 7/1987 Scolari ..... A63H 33/009 315/241 P
4,904,222 A * 2/1990 Gastgeb ..... A63H 5/00 310/331

(Continued)

OTHER PUBLICATIONS

Mikaela, PCC Samoan Fire Knives vs. Batons, Culture of Polynesia, Samoa, Polynesian Culture Center, Web Blog, Jul. 3, 2017 (Year: 2017).*

(Continued)

*Primary Examiner* — Andrew J Coughlin
*Assistant Examiner* — Keith G. Delahoussaye
(74) *Attorney, Agent, or Firm* — Lowenstein Sandler LLP

(57) ABSTRACT

A light emitting fire knife device includes a blade structure, a first planar light emitting component, a second planar light emitting component, a handle structure, and a first cylindrical light emitting component. The blade structure includes a first distal end and a second distal end opposite the first distal end. The first planar light emitting component is disposed on a first planar surface of the blade structure and the second planar light emitting component is disposed on a second planar surface of the blade structure, where the second planar surface is opposite the first planar surface. The handle structure includes a third distal end and a fourth distal end opposite the third distal end, where the third distal end is configured to removably secure to the second distal end of the blade structure. The first cylindrical light emitting component is secured around the handle structure proximate the fourth distal end of the handle structure.

20 Claims, 10 Drawing Sheets

(51) Int. Cl.

| | |
|---|---|
| ***F41B 15/00*** | (2006.01) |
| ***F21S 10/04*** | (2006.01) |
| ***F21V 23/06*** | (2006.01) |
| ***F21V 23/00*** | (2015.01) |
| ***F21S 9/02*** | (2006.01) |
| ***B26B 1/10*** | (2006.01) |
| ***A63H 33/00*** | (2006.01) |
| *F21Y 115/10* | (2016.01) |
| *F21Y 105/00* | (2016.01) |

(56) References Cited

U.S. PATENT DOCUMENTS

| | | | | |
|---|---|---|---|---|
| 5,947,789 | A * | 9/1999 | Chan | A63H 33/009 362/277 |
| 10,113,576 | B1 * | 10/2018 | Weeks | F16B 21/02 |
| 2013/0223045 | A1 * | 8/2013 | Cammenga | B26B 11/008 362/119 |
| 2014/0106644 | A1 * | 4/2014 | Urbaniak | A63H 33/00 446/473 |
| 2018/0099423 | A1 * | 4/2018 | Mundhra | B26B 1/044 |
| 2019/0293384 | A1 * | 9/2019 | Abbatescianni | A63B 71/0622 |

OTHER PUBLICATIONS

2194 United States (Hawaii)—The Samoan Fire Knife Dance, Web Blog, p. 1, Jan. 7, 2016 (Year: 2016).* https://lighttoys.cz/product-category/led-products-ft/ retrieved Dec. 26, 2019.

https://lighttoys.cz/store/led-products-ft/ft-led-products/fantastick-ft/ retrieved Dec. 26, 2019.

https://www.americanbaton.com/light-stick-batons-2-2-5 retrieved Dec. 26, 2019.

* cited by examiner

LIGHT EMITTING FIRE KNIFE DEVICE

RELATED APPLICATION

This application claims the benefit of U.S. Provisional Application No. 62/785,827, filed Dec. 28, 2018, the content of which is hereby incorporated by reference in its entirety.

BACKGROUND

A fire knife (e.g., Samoan fire knife) is used in ceremonial fire knife dances, fire knife competitions, and fire knife performances. Material that has been soaked in flammable liquid is attached to the blade of the fire knife and to the handle of the fire knife. During ceremonial dances, the material is set on fire and performers dance while twirling, throwing, and catching one or more fire knives and doing other acrobatic stunts.

DESCRIPTION OF DRAWINGS

The figures depict certain embodiments of the present disclosure. These embodiments illustrated should not be seen as limiting the present disclosure and further embodiments which vary from the illustrated embodiments are described in the detailed description.

DETAILED DESCRIPTION

Figures 1A, 1B, 1C, 1D:
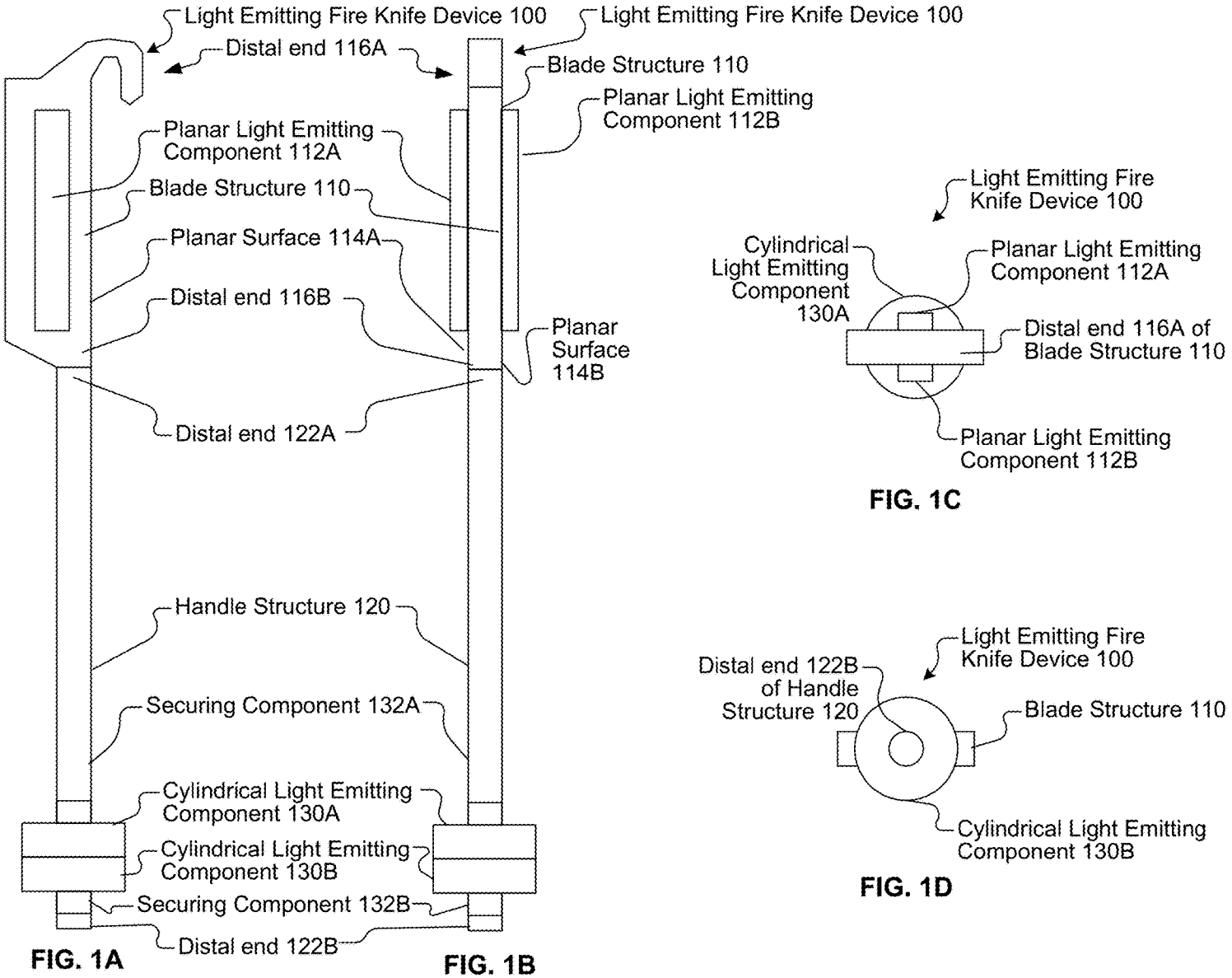
FIGS. 1A-D illustrate a light emitting fire knife device, according to certain embodiments.

Disclosed herein are technologies related to a light emitting fire knife device. A fire knife (e.g., nifo oti, Samoan fire knife) is used in fire knife dancing (e.g., siva afi, ailao afi). The Samoan siva afi (e.g., fire knife dancing) has become a popular part of recreation, competition, and performances (e.g., Polynesian luaus and shows) in the Samoan islands, other Polynesian islands (e.g., Tahiti, Hi., Cook Islands, Fiji, Tonga, etc.), and many other parts of the world.

Whereas a baton used for twirling is a rod that is cylindrical, symmetrical, lightweight, and has a center of gravity in the middle of the rod, the fire knife has a non-cylindrical blade, is asymmetrical, is heavier, and may have an offset center of gravity. The fire knife has a sharp blade (e.g., made of metal) on one end and a handle (e.g., made of wood) at the other end. The blade has a first planar surface and a second planar surface and the handle is cylindrical. Material is secured to the first planar surface of the blade, to the second planar surface of the blade, and around a distal end of the handle, leaving a middle portion of the fire knife that is not covered in the material. The material is soaked in a flammable liquid and is set on fire for the fire dancing. After the material is set on fire, the user dances while rapidly twirling, throwing, and catching one or more fire knives via the middle portion of the fire knives while performing other acrobatic stunts. A user may perform fire knife dancing alongside other fire dancers, in a performance (e.g., luau festivity, Polynesian shows, etc.) for an audience, in a competition for judges, or the like. Due to the close proximity of the fire knives with people and other surroundings, the ends of the fire knives being set on fire, the increase in temperature of the portions of the fire knives proximate the fire, the sharp blades of the fire knives, the rapid movements of the fire knives, the throwing and catching of fire knives, the twirling of the fire knives, and so forth, conventional fire knives may cause injury to people and to surroundings. Conventional fire knives are even more prone to cause injury and damage when used by inexperienced users (e.g., children, new users, etc.) and/or when used in confined surroundings. Some locations do not allow fire, sharp objects, and/or traditional fire knives for safety and other concerns. Due to the danger of injury and damage, experienced fire knife users may be reluctant to teach inexperienced fire knife users (e.g., children, new users) how to use fire knives and/or inexperienced users may try to learn how to use fire knives without supervision, increasing the chances of injury and damage.

Batons used for baton twirling are structurally and functionally very different from fire knives. Batons are cylindrical which is different from the non-cylindrical blade of fire knives. Batons are symmetrical which is different from asymmetrical fire knives. Batons are lightweight with a center of gravity in the middle of the baton which is different from heavier fire knives that may have an offset center of gravity (e.g., due to a metal blade and a wooden handle). Batons do not have a blade portion that has a first and second planar surface. Batons do not have fire or emit light on the first planar surface, on the second planar surface, and around a distal end of the handle. Batons lack many of the structural and functional attributes of fire knives that make spectating and participating in fire knife dancing unique and so enjoyable.

The devices, systems, and methods disclosed herein provide a light emitting fire knife device. A light emitting fire knife device includes a blade structure and a handle structure that are removably secured to each other. The blade structure has a first planar surface and a second planar surface opposite the first planar surface. The handle structure may be cylindrical. The light emitting fire knife device also includes a first planar light emitting component disposed on the first planar surface and a second planar light emitting component disposed on the second planar surface. The light emitting fire knife device also includes one or more cylindrical light emitting components secured around the handle structure proximate a distal end of the handle structure (e.g., away from the blade structure).

The light emitting fire knife device may closely reflect the function, look, feel, dimension, weight, and purpose of a traditional Samoan fire knife. The light emitting fire knife device may provide authenticity of spinning traditional Samoan fire knives. The light emitting fire knife device may provide a safe form of spinning the traditional Samoan fire knife commonly used in popular commercial Polynesian luau fire dance shows and other performances/competitions. The light emitting fire knife device may provide an interactive light-up spinning fire knife that resembles the art of spinning fire (e.g., provides the illusion of fire), where the look of fire is achieved through various patterns of lights chosen by the user. The dimensions, and design of the light emitting fire knife device may appropriately resemble the traditional Samoan fire knife. The light emitting fire knife is designed to share the story and art of Polynesian fire dancing.

The burn pads on a traditional fire knife come in two shapes. On the blade of the fire knife are rectangular wooden burn pads. On the end of the fire knife are donut shaped burn pads. The burn pads are secured onto the traditional fire knife with metal wiring. In the light emitting fire knife device, block (e.g., planar light emitting components) and donut (e.g., one or more cylindrical light emitting components) lights may be constructed of light emitting devices (e.g., LEDs) encased in a material (e.g., silicon, plastic, or the like). The planar light emitting components are secured onto the blade structure of the light emitting fire knife device (e.g., via a locking track system, via being disposed in a recess formed by the blade structure and covered with a transparent material, etc.). The one or more cylindrical light emitting components may be secured via securing components (e.g., rubber-like capping system, cylindrical components secured to the handle structure via one or more fasteners). One or more of the planar light emitting components and/or the one or more cylindrical light emitting components may secure to and release from the light emitting fire knife device, similar to burn pads securing to and releasing from traditional Samoan fire knives.

The light emitting fire knife device is a safe alternative to the traditional Samoan fire knife and provides the capacity to spin fire knives in many settings (e.g., recreation, competitions, performances, and/or the like), without the risk of being cut or burned, and can be used by users of various abilities. The light emitting fire knife device is configured for use by multiple skill levels from beginner to professional. The light emitting fire knife device may be configured to separate and/or fold for easy storage (e.g., to fit in standard-sized travel luggage.

The present disclosure has technical advantages compared to conventional devices. The light emitting fire knife device emits light from the first and second planar surfaces of the blade and from the distal end of the handle without using fire, without consuming material and flammable liquid, without causing smoke, without the risk of burning users or surroundings, and with less temperature increase (or no temperature increase) compared to traditional fire knives. The blade structure of the light emitting fire knife device is not sharp, thereby reducing injury to users and damage of surroundings. The blade structure and the handle structure are configured to attach to each other and detach from each other, thereby facilitating transportation and storage of the light emitting fire knife device. The light emitting fire knife device may have similar dimensions, weight, center of gravity, materials, and/or the like compared to traditional fire knives, thereby allowing the same fire knife dance techniques to be performed with the light emitting fire knife device as with the traditional fire knife. The light emitting fire knife device may be used by inexperienced users to learn fire knife dancing, may be used by experienced users to try out new techniques, may be used in locations where fire is not allowed, and may be used by all users without the risk of injury and damage associated with traditional fire knives. The light emitting fire knife device provides structural and functional attributes similar to a traditional fire knife, whereas a traditional baton is not able to provide the same structural and functional attributes. In some embodiments, the light emitting fire knife device may be interchangeably used with other light emitting components or with actual fire (e.g., material soaked in flammable material and attached to the light emitting fire knife device, etc.).

It may be noted that light emitting fire knife devices being used for fire knife dancing is for purposes of illustration, rather than limitation. In some embodiments, the device may not be light emitting (e.g., does not provide light, is configured to use with actual fire, etc.). In some embodiments, the light emitting fire knife device (e.g., via one or more planar light emitting components and/or one or more cylindrical light emitting components) one or more of emits light, is luminescent, is illuminating, is incandescent, is phosphorescent, is chemiluminescent, and/or the like. In some embodiments, the device may be in a form that differs from a traditional fire knife. In some embodiments, the device may not be used for fire knife dancing. In some embodiments, the spinning device of FIGS. 5A-D may be used with other devices (e.g., used for spinning other devices) other than a light emitting fire knife device.

FIGS. 1A-D illustrate a light emitting fire knife device 100, according to certain embodiments. FIG. 1A illustrates a front view of the light emitting fire knife device 100, according to certain embodiments. FIG. 1B illustrates a side view of the light emitting fire knife device 100, according to certain embodiments. FIG. 1C illustrates a top view of the light emitting fire knife device 100, according to certain embodiments. FIG. 1D illustrates a bottom view of the light emitting fire knife device 100, according to certain embodiments.

A light emitting fire knife device 100 includes a blade structure 110 (e.g., light emitting blade structure) and a handle structure 120 (e.g., light emitting handle structure). A distal end 116A of the blade structure 110 may form a hook (e.g., meeting fire knife competition rules). The hook and the edges of the blade structure 110 may be a dull-edged material (e.g., rounded surfaces) so as to not cause injury and damage. The hook and edges of the blade structure 110 may be covered with a layer of material (e.g., dipped in plastic) to avoid injury and damage. In some embodiments, all or substantially all of the external edges of the light emitting fire knife device 100 are rounded and/or covered with a layer of material.

A distal end 116B of the blade structure 110 and a distal end 122A of the handle structure 120 may be removably secured to each other. The distal end 116B of the blade structure 110 and the distal end 122A of the handle structure 120 may be secured by one or more of a fastener (e.g., screw, bolt, push pin, etc.), a friction fit, threading, or the like. The distal end 116B of the blade structure 110 and the distal end 122A of the handle structure 120 may secure to each other so that the blade structure 110 and handle structure 120 do not separate during use (e.g., twirling, throwing, catching, fire knife dancing, etc.) of the light emitting fire knife device 100. The blade structure 110 may be interchangeable with other handle structures 120 (e.g., handle structures of different dimensions, handle structures of different materials, other handle structures configured for one or more cylindrical light emitting components 130, other handle structures not configured for cylindrical light emitting components 130 (e.g., a handle of a traditional fire knife), etc.). The handle structure 120 may be interchangeable with other blade structures 110 (e.g., blade structures of different dimensions, blade structures of different materials, other blade structures configured for one or more planar light emitting components 112, other blade structures not configured for planar light emitting components 112 (e.g., a blade of a traditional fire knife), etc.).

The blade structure 110 may have a first planar surface 114A and a second planar surface 114B (e.g., front view of a first planar surface 114A is shown in FIG. 1A, side views of the first and second planar surfaces 114A-B are shown in FIG. 1B). The first and second planar surfaces 114A-B may be substantially parallel to each other. A planar light emitting component 112 may be disposed on each planar surface 114.

In some embodiments, each planar surface 114 forms a recess and the planar light emitting component 112 is disposed in the recess. Responsive to the planar light emitting component 112 being disposed in the recess, the planar light emitting component 112 may be substantially planar with the first planar surface 114 (e.g., responsive to the rear surface of the planar light emitting component 112 being disposed in the recess, the front surface of the planar light emitting component 112 may be substantially planar with the first planar surface 114). In some embodiments the planar light emitting component 112 is removable from the planar surface 114 and replaceable with another planar light emitting component 112. In some embodiments, the light emitting component 112 is integral to the blade structure 110. In some embodiments, multiple light emitting devices are disposed in each planar surface 114 of the blade structure 110 (e.g., each light emitting device is disposed in their own recess, multiple light emitting devices are disposed in the same recess, etc.).

In some embodiments, an interface (e.g., mounting component) is secured to the planar surface 114 and the planar light emitting component 112 is removably secured to the planar surface 114 via the interface. The light emitting component 112 may be removed from the planar surface 114 and replaced with a different light emitting component (e.g., different colors, different sequence, different lights, or the like). The light emitting component 112 may be removed from the planar surface 114 and material (e.g., material configured to be soaked in flammable liquid, fire pads, etc.) for providing actual fire may be attached to the planar surface 114. The blade structure 110 may have one or more openings (e.g., holes, channels, etc.) for securing the material to the blade structure 110 (e.g., via one or more wires going through a first opening in the blade structure 110, over the front surface of the material and through a second opening in the blade structure 110 to secure the material to the planar surface 114). The handle structure 120 may have one or more openings (e.g., holes, channels, etc.) for securing the material (e.g., donuts) to the handle structure 120 (e.g., via one or more wires going through a first opening in the handle structure 120 above the donut, over the front surface of the donut, and through a second opening in the handle structure 120 to secure the donut to the handle structure 120).

The planar light emitting component 112 and the blade structure 110 may secure to each other so that the planar light emitting component 112 does not separate from the blade structure 110 during use (e.g., twirling, throwing, catching, etc.) of the light emitting fire knife device 100.

In some embodiments, each planar light emitting component 112 includes one or more of a user interface, a battery (e.g., configured to power the planar light emitting component 112), light emitting devices (e.g., light emitting diodes (LEDs), etc.), a charging interface (e.g., to couple to a power source to charge the battery), a wireless module, a processing device, and/or the like. Each planar light emitting component 112 may be separately controlled (e.g., turn on light emitting devices, change color of light emitting devices, change sequence of light emitting devices, change speed of light emitting devices, change flashing pattern of the light emitting devices, change brightness of light emission of the light emitting devices, etc.) via a corresponding user interface. Each user interface may include one or more buttons, knobs, graphical user interface, or the like. In some embodiments, each planar light emitting component 112 has a wireless module and is controlled by sending a wireless signal from a user device (e.g., smart phone, remote control, computer, etc.) to the wireless module of the planar light emitting component 112 (e.g., via a wireless network, via WiFi, via Bluetooth, etc.).

In some embodiments, the planar light emitting component 112 includes light emitting devices and the blade structure 110 and/or the handle structure 120 includes one or more of a user interface, a battery, light emitting devices (e.g., light emitting diodes (LEDs), etc.), a charging interface (e.g., to couple to a power source to charge the battery), a wireless module, a processing device, and/or the like. In some embodiments, the user interface (e.g., disposed on the blade structure 110, disposed on the handle structure 120) receives user input for simultaneous control of the planar light emitting components 112A-B. In some embodiments, the wireless module (e.g., disposed on the blade structure 110, disposed on the handle structure 120) receives user input for simultaneous control of the planar light emitting components 112A-B. For example, the processing device of the light emitting fire knife device 100 may receive user input (e.g., via the user interface, via the wireless module) and the processing device may control the planar light emitting components 112A-B simultaneously based on the user input. In some embodiments, the processing device of the light emitting fire knife device 100 receives first and second user input (e.g., via the user interface, via the wireless module) and the processing device controls the first planar light emitting component 112A based on the first user input and controls the second planar light emitting component 112B based on the second user input.

The handle structure 120 may be cylindrical. A handling portion (e.g., middle portion, the center of gravity, etc.) of the light emitting fire knife device 100 may correspond to a handling portion of the handle structure 120 (e.g., distal end of the handle structure 120 that is proximate the blade structure 110) that does not have a user interface or any protrusions. Any fasteners (e.g., securing the handle structure 120 to the blade structure 110) in the handling portion of the handle structure 120 may be recessed to not injure the user during handing of the light emitting fire knife device 100. The user interface may be located on a surface (e.g., a planar surface 114) of the light emitting fire knife device 100 that does not correspond to the handling portion to not receive inadvertent user input during handling (e.g., twirling, throwing, catching, etc.) of the light emitting fire knife device 100. In some embodiments, a first user interface (e.g., power button to turn on and turn off the light emitting fire knife device 100) may be located on the distal end 122B of the handle structure 120 (e.g., proximate the charging interface) and a second user interface (e.g., mode button, speed button) is located on the planar surface 114 of the blade structure 110. In some embodiments, the mode button may be actuated until arriving at a particular mode (e.g., each time the mode button is clicked, the one or more light emitting components go into a different mode).

The handle structure 120 may have a distal ends 122A-B. The distal end 122A may be configured to secure to a distal end of the blade structure 110 (e.g., via one or more of a fastener, friction fit, threading, etc.). One or more cylindrical light emitting components 130 may be secured to the handle structure 120 proximate the distal end 122B. In some embodiments, the cylindrical light emitting components 130 do not spin around the handle structure 120 (e.g., are in a fixed orientation). A feature associated with (e.g., a protruding feature secured to) the handle structure 120 (e.g., via a set screw, push pin, etc.) may correspond with a feature (e.g., recess) of the cylindrical light emitting component 130 and may prevent the cylindrical light emitting component 130 from rotating around the handle structure 120. In some embodiments, the handle structure 120 forms an opening and wires are routed from the handle structure 120 and through the opening to couple with the light emitting devices within the cylindrical light emitting component 130. In some embodiments, the cylindrical light emitting components 130 (e.g., the housing of the cylindrical light emitting component 130, the housing and light emitting device of the cylindrical light emitting component 130) may spin around the handle structure 120 during use (e.g., twirling, throwing, catching, etc.) of the light emitting fire knife device 100.

In some embodiments, a cylindrical light emitting component 130 has a light emitting device embedded in a material (e.g., silicon) (e.g., the light emitting device is not removable from the cylindrical light emitting component 130). In some embodiments, the cylindrical light emitting component 130 includes a housing (e.g., silicon housing) that forms a chamber around the handle structure 120 and a light emitting device is disposed within the chamber (e.g., the light emitting device is removable from the cylindrical light emitting component 130, the light emitting device is configured to be replaced and/or interchanged with one or more other light emitting devices). The light emitting device (e.g., in the chamber) may be wrapped around the handle structure 120.

In some embodiments, one or more securing components 132A-B secure one or more cylindrical light emitting components 130A-B to the handle structure 120. In some embodiments, the cylindrical light emitting components 130A-B each form an opening (e.g., inner diameter) that has substantially the same diameter of the handle structure 120 (e.g., to provide a friction fit between the cylindrical light emitting component 130 and the handle structure 120). In some embodiments, the cylindrical light emitting components 130A-B each form an opening (e.g., inner diameter) that is larger than the same diameter of the handle structure 120 (e.g., to allow the cylindrical light emitting components 130 to rotate around the handle structure 120, such as during twirling, throwing, catching, etc.). In some embodiments, one or more components are disposed between the inner diameter of the cylindrical light emitting components 130A-B and the outer diameter of the handle structure 120 to provide a secure fit between the cylindrical light emitting components 130A-B and the handle structure 120. A first securing component 132A may be secured to the handle structure 120 above the one or more cylindrical light emitting components 130A-B and a second securing component 132B may be secured to the handle structure 120 below the one or more cylindrical light emitting components 130A-B to limit (e.g., prevent) lateral movement of the cylindrical light emitting components 130A-B along the handle structure 120 (e.g., to prevent the cylindrical light emitting components 130A-B from entering the handling portion of the handle structure 120 and to prevent the cylindrical light emitting components 130A-B from falling off of the handle structure 120 during use, such as twirling, throwing, catching, etc. of the light emitting fire knife device 100). In some embodiments, the securing components 132A-B secure to the handle structure 120 via a friction fit. In some embodiments, the securing components 132A-B secure to the handle structure 120 via one or more fasteners (e.g., set screws, push pin, etc.). In some embodiments, additional cylindrical light emitting components 130 may be added or removed by adjusting the location of the securing components 132A-B on the handle structure 120. In some embodiments, one or more cylindrical light emitting components 130 may be replaced with a cylindrical light emitting component 130 of a different size by adjusting the location of the securing components 132A-B on the handle structure 120 (e.g., the handle structure 120 may have multiple openings to receive a fastener (e.g., set screw) for repositioning the securing component 132A to accommodate additional cylindrical light emitting components 130 and/or different size of cylindrical light emitting component 130).

In some embodiments, each cylindrical light emitting component 130 includes one or more of a user interface, a battery (e.g., configured to power the planar light emitting component 112), light emitting devices (e.g., LEDs, etc.), a charging interface (e.g., to couple to a power source to charge the battery), a wireless module, a processing device, and/or the like. Each cylindrical light emitting component 130 may be separately controlled (e.g., turn on light emitting devices, change color of light emitting devices, change sequence of light emitting devices, change speed of light emitting devices, change brightness of light emitting by the light emitting devices, etc.) via a corresponding user interface. Each user interface may include one or more buttons, knobs, graphical user interface, or the like. In some embodiments, each cylindrical light emitting component 130 has a wireless module and is controlled by sending a wireless signal from a user device (e.g., smart phone, remote control, computer, etc.) to the wireless module of the cylindrical light emitting component 130.

In some embodiments, the cylindrical light emitting component 130 includes light emitting devices and the blade structure 110 and/or the handle structure 120 includes one or more of a user interface, a battery, light emitting devices (e.g., light emitting diodes (LEDs), etc.), a charging interface, a wireless module, a processing device, and/or the like. In some embodiments, the user interface (e.g., disposed on the blade structure 110, disposed on the handle structure 120) receives user input to control the planar light emitting components 112A-B and/or one or more cylindrical light emitting components 130A-B simultaneously. In some embodiments, the wireless module (e.g., disposed on the blade structure 110, disposed on the handle structure 120) receives user input to control the planar light emitting components 112A-B and/or one or more cylindrical light emitting components 130A-B simultaneously. For example, the processing device of the light emitting fire knife device 100 may receive user input (e.g., via the user interface, via the wireless module) and the processing device may control the planar light emitting components 112A-B and/or one or more cylindrical light emitting components 130A-B simultaneously based on the user input. In some embodiments, the processing device of the light emitting fire knife device 100 receives first and second user input (e.g., via the user interface, via the wireless module) and the processing device controls the first cylindrical light emitting component 130A based on the first user input and controls the second cylindrical light emitting component 130B based on the second user input.

The light emitting fire knife device 100 may include a charging interface (e.g., configured to couple to a power source to charge (e.g., power) the battery of the battery of light emitting fire knife device 100). A battery of the light emitting fire knife device 100 may be charged via the charging interface (e.g., via a first portion of the charging interface). The battery of the light emitting fire knife device 100 may charge other components (e.g., charge a smart phone) via the charging interface (via a second portion of the charging interface, via a USB-type connector of the charging interface). The charging interface may be located at the distal end 122B of the handle structure 120. In some embodiments, a cover (e.g., cap) is used to cover the charging interface.

In some embodiments, the blade structure 110 includes a first electrical connector and the distal end 122A of the handle structure 120 includes a second electrical connector (e.g., embedded within the handle structure 120). The blade structure 110 and the handle structure 120 may connect to each other via the electrical connectors. One or more of the battery, wireless module, processing device, memory (e.g., for storing keys, light sequences, etc.), user interface, charging interface, etc. may be located within the blade structure 110 and/or handle structure 120 (e.g., located near the center of gravity of the light emitting fire knife device 100) and may be coupled to each other via the electrical connectors. For example, the blade structure 110 may include one or more of the user interface, processing device, and/or electrical connection to the planar light emitting components 112A-B and the handle structure 110 may include one or more of the charging interface, battery, and/or electrical connection to the one or more cylindrical light emitting components 130A-B.

The light emitting fire knife device 100 may have a shape, weight, and/or dimensions similar to that of a traditional fire knife. The light emitting fire knife device 100 may meet the shape, weight, and/or dimensions of fire knife competition rules. The light emitting fire knife device 100 may simulate a single-blade knife (e.g., one sided blade) or a double-bladed knife (e.g., two-sided blade). When simulating a single-blade knife, the light emitting fire knife device 100 may be at least 37 inches long from the tip of the hook to the end of the handle, the blade length may be at least 14 inches from the tip of the hook to where the blade flares to the handle, the planar light emitting component 112 may have a length (e.g., fireboard length) of at least 10 inches, and/or the planar light emitting component 112 may have a width (e.g., fireboard width) of at least 2 inches. When simulating a double-blade knife, the light emitting fire knife device 100 may be at least 35 inches long (e.g., about 35-37 inches long) from the tip of the hook to the end of the handle, the blade length may be at least 13 inches from the tip of the hook to where the blade flares to the handle, the fireboard length may be at least 7.5 inches, and/or the fireboard width may be at least 1.5 inches. The blade may be solid. The blade may not have the middle portion cut out. The blade structure 110 may have a minimum of two metal rivets to hold the blade structure 110 in place through the handle structure 120. The blade structure 110 may have a hook large enough to hook together with a hook of another blade structure 110. The hook may be free at all angles when hooked together to prevent injury to the user and spectators.

In some embodiments, the light emitting fire knife device 100 is at least 35 inches from the distal end of the blade structure 110 (e.g., from the tip of the hook) to the distal end 122B of the handle structure 120B. In some embodiments, the blade structure 110 of the light emitting fire knife device 100 has a hook configured to hook to other light emitting fire knife devices 100 and/or other traditional fire knives. In some embodiments, handle structures 120 of different lengths may be used with a blade structure 110 of a standard size. In some embodiments, blade structures 110 of different types (e.g., different colors, different designs, different planar light emitting components 112, for use with fireboard and fire, etc.) may be used with the same handle structure 120.

Components (e.g., blade structure, planar light emitting components 112A-B, handle structure 120, cylindrical light emitting components 130A-B, securing components 132A-B, cap on the distal end 122B, fasteners, etc.) of the light emitting fire knife device 100 are configured to remain secured to each other during fire dancing. Fire dancing may include one or more of spinning the light emitting fire knife device 100 with one hand (e.g., viii tasi), spinning the light emitting fire knife device 100 with two hands (e.g., vili lua), overhand connection move with the light emitting fire knife device 100 (e.g., kakai with the left and the right hands, kakai in and kakai out and over the palm, etc.), the user tossing the light emitting fire knife device 100 up and the user catching the light emitting fire knife device 100 in back of the user, under the legs motion of the light emitting fire knife device 100, around the neck motion of the light emitting fire knife device 100, around the ankle and catch under the leg motions of the light emitting fire knife device 100, feet stamping and body movement while handling the light emitting fire knife device 100, head and upper body movements while handling the light emitting fire knife device 100, stage showmanship (e.g., portraying a warrior) while handling the light emitting fire knife device 100, standing motions with the light emitting fire knife device 100, kneeling moves with the light emitting fire knife device 100, lying down moves with the light emitting fire knife device 100, moves that include securing the light emitting fire knife device 100 with another fire knife (e.g., another light emitting fire knife device 100, a traditional fire knife, etc.) via the hooks of the blade structures (e.g., hooked double knives), exciting entrance and exits with the light emitting fire knife device 100, throws of the light emitting fire knife device 100 of double of the height of the user or higher, difficult motions (e.g., with or without the light emitting fire knife device 100 dropping), rapid spins and motions of the light emitting fire knife device 100, vigorous and energetic Samoan warrior's moves (e.g., portraying a fighting warrior) with the light emitting fire knife device 100, and/or the like.

FIGS. 2A-G illustrate fire knife devices 200A-F, according to certain embodiments. One or more components of each of the fire knife devices 200A-F may be similar or the same as the light emitting fire knife device 100 of FIGS. 1A-D. In some embodiments, components of the fire knife devices 200A-F are interchangeable with components of the light emitting fire knife device 100 of FIGS. 1A-D. In some embodiments, components of the light emitting fire knife device 100 of FIGS. 1A-D are interchangeable with the fire knife devices 200A-F.

Figures 2A, 2B, 2C, 2D, 2E, 2F, 2G:
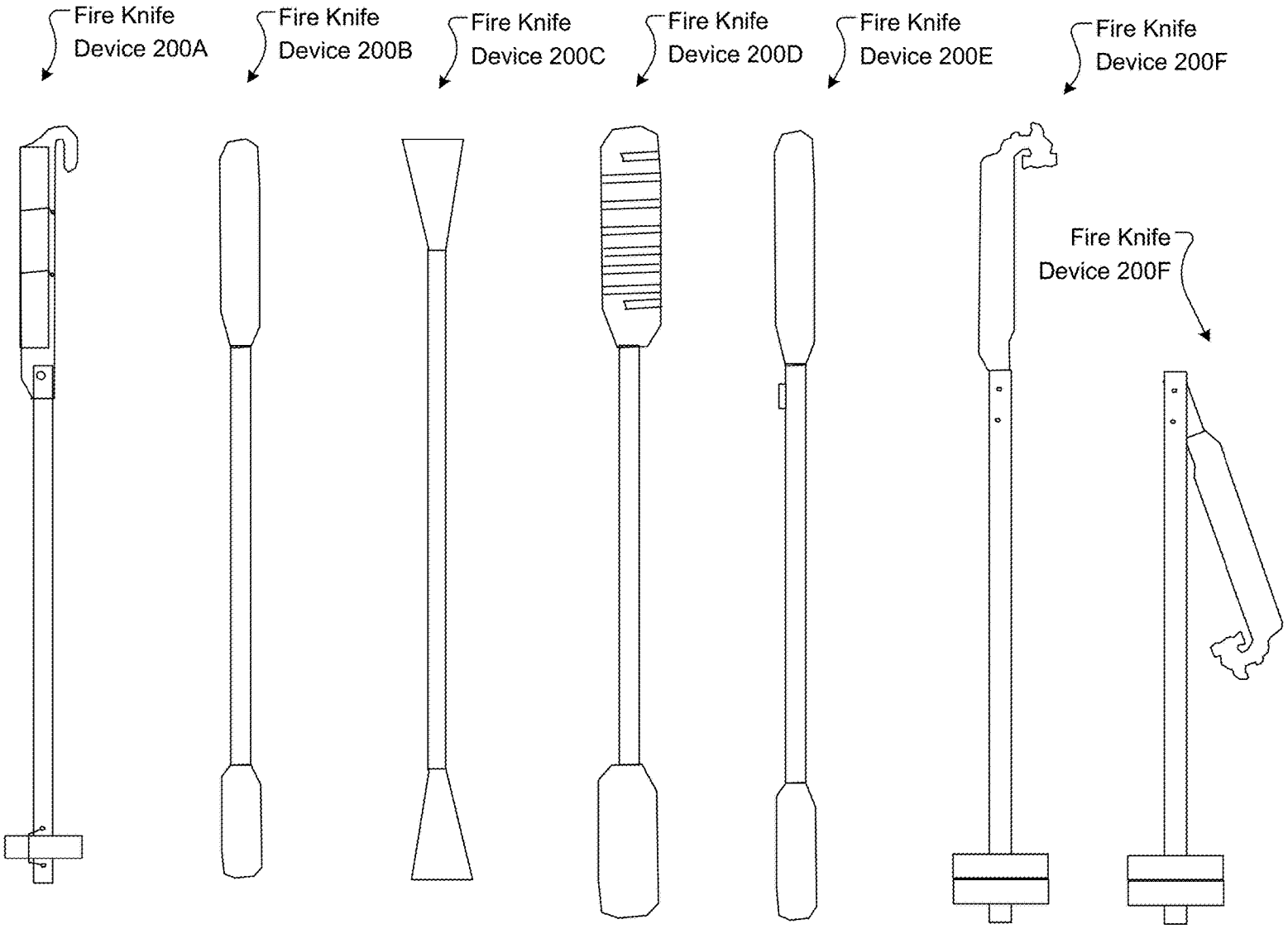
FIGS. 2A-G illustrate light emitting fire knife devices, according to certain embodiments.

FIG. 2A illustrates a fire knife device 200A which may be similar to a traditional Samoan fire knife that includes a blade, a fireboard, a handle, and donuts. The blade may also be referred to as a machete or a knife and may be made out of sheet metal or aluminum. The fireboard may be referred to as blade board or Kevlar wick/wrap. The fireboard may be made of Kevlar, particle board, rags, wooden burn pads, or other material that soaks up flammable liquid and may be secured by metal wiring to the blade. The handle may be referred to as a dowel, staff, or stick and may be made of aluminum, wood, or aluminum with a wood dowel inside.

The handle may be wrapped (e.g., with electrical tape, insulating tape, pressure-sensitive tape, etc.). The donuts may be referred to as doughnuts, fire pads, single roll wick, or double roll wick. The donuts may be made of Kevlar, particle board, rags or other material soaks up flammable liquid. The donuts may be secured by metal wiring to the handle.

Fire knife device 200A may include the blade structure 110, the handle structure 120, one or more planar light emitting components 112, and/or one or more cylindrical light emitting components 130 of light emitting device 100 of FIGS. 1A-D. For example, light emitting fire knife device 100 and fire knife device 200A may include the same blade structure 110 and/or handle structure 120 of light emitting device 100 of FIGS. 1A-D. The blade structure 110 may be configured to be used interchangeably with planar light emitting components 112 for a first fire dance and with fireboard (e.g., that has been soaked in flammable liquid and set on fire) for a second fire dance. The handle structure 120 may be configured to be used interchangeably with cylindrical light emitting components 130 for a first fire dance and with one or more donuts (e.g., that have been soaked in flammable liquid and set on fire) for a second fire dance. The one or more planar light emitting components 112 and/or one or more cylindrical light emitting components 130 may be secured to the blade structure 110 and/or handle structure 120 for fire dancing without fire. The fireboard and/or donuts may be secured to the blade structure 110 and/or handle structure 120 for fire dancing with fire.

FIGS. 2B-E illustrate fire knife devices 200B-E that may have a padded, covered, and/or wrapped end. In some embodiments, a first portion of any of the fire knife devices 200B-E (e.g., corresponding to the blade of a traditional fire knife) may be detachable from a second portion of the fire knife device 200B-E (e.g., corresponding to a handle). The first portion of the fire knife device 200B-E may be interchangeable with the blade structure 110 of the light emitting fire knife device 100. The second portion of the fire knife device 200B-E may be interchangeable with the handle structure 120 of the light emitting fire knife device 100. In some embodiments, any of fire knife devices 200B-E includes the blade structure 110 and/or the handle structure 120 of the light emitting fire knife device 100 that have been wrapped in a cover (e.g., to avoid injury of inexperienced users). A first cover may be removably attached to the blade structure 110 of the light emitting fire knife device 100 and/or a second cover may be removably attached to the handle structure 120 of the light emitting fire knife device 100 for inexperienced users, for users that are learning or developing new techniques, for transportation, for storage, etc. to avoid injury and damage.

FIG. 2B illustrates a fire knife device 200B which may be similar to the traditional Samoan fire knife practice stick. Fire knife device 200B may include a padded end blade, a handle, and a padded end donut. The padded end blade may be referred to as a larger padded end and may include towels around a dowel that have been wrapped (e.g., with electrical tape, insulating tape, pressure-sensitive tape, etc.). The handle may also be referred to as a dowel, a staff, a stick, or a balance rod. The handle may be made of wood, polyvinyl chloride (PVC), or metal and may be wrapped (e.g., with electrical tape, insulating tape, pressure-sensitive tape, etc.). The padded end may be referred to as a smaller padded end and may be made from towels around a dowel that have been wrapped (e.g., with electrical tape, insulating tape, pressure-sensitive tape, etc.).

FIG. 2C illustrates a fire knife device 200C. The fire knife device 200C may be similar to a fire knife practice stick with padded ends (e.g., see FIG. 2B) where light emitting devices (e.g., flashlights) are added to the distal ends of the fire knife device 200C for light effect. The light emitting devices may function by pushing on the lens to turn on or off. Each end of the fire knife device 200C may have matching light emitting devices. The first light emitting device on the first distal end and the second light emitting device on the second distal end may operate independently from each other. The weight of the fire knife device 200C may be slightly increased compared to the weight of the fire knife device 200B.

FIG. 2D illustrates a fire knife device 200D. The fire knife device 200D may be similar to the fire knife practice stick with padded ends (e.g., see FIG. 2B) where the distal ends (e.g., padded ends) are wrapped in light emitting devices (e.g., LED strips). The distal ends may be made with hollow tubing (e.g., hollow cardboard tubing) to house the battery (e.g., house the power pack and access batteries). The distal ends may each include a twist cap to hold the battery (e.g., power pack) inside). The light emitting device (e.g., LED strip lights) may be wrapped around the outside of the hollow tubing (e.g., cardboard). The distal ends may be wrapped (e.g., in heat shrink plastic) to protect the light emitting devices (e.g., LED strips). The distal ends may include stitching to allow access to a light controller for control of the light emitting devices. The handle may be wrapped (e.g., with electrical tape, insulating tape, pressure-sensitive tape, etc.). The light emitting devices (e.g., LED strip lights) may produce multiple color choices and modes. The batteries may be accessible. The first light emitting device on the first distal end may operate independently from the second light emitting device on the second distal end.

FIG. 2E illustrates a fire knife device 200E. The fire knife device 200E may be similar to the fire knife practice stick with padded ends (e.g., see FIG. 2B) where the distal ends (e.g., padded ends) include light emitting devices (e.g., LED strips). Each distal end of the fire knife device 200E may include a string of LED lights that are wrapped from the distal end to the controller on the handle. Each distal end of the fire knife device 200E may have a string of LED lights that is independently operated with a control (e.g., on/off sliding switch). The fire knife device 200E may be light in weight and easy to spin.

FIGS. 2F-G illustrate a fire knife device 200F. The fire knife device 200F may be made from wood. The fire knife device 200F may or may not include light emitting devices. The fire knife device 200F may have a design similar to that of a traditional fire knife (e.g., instead of a practice stick). The fire knife device 200F may include a pivot point for easy folding for storage, travel, or to fit into a suitcase. The blade of the fire knife device 200F may have a hook (e.g., a hammerhead shark design).

Figures 3A, 3B, 3C:
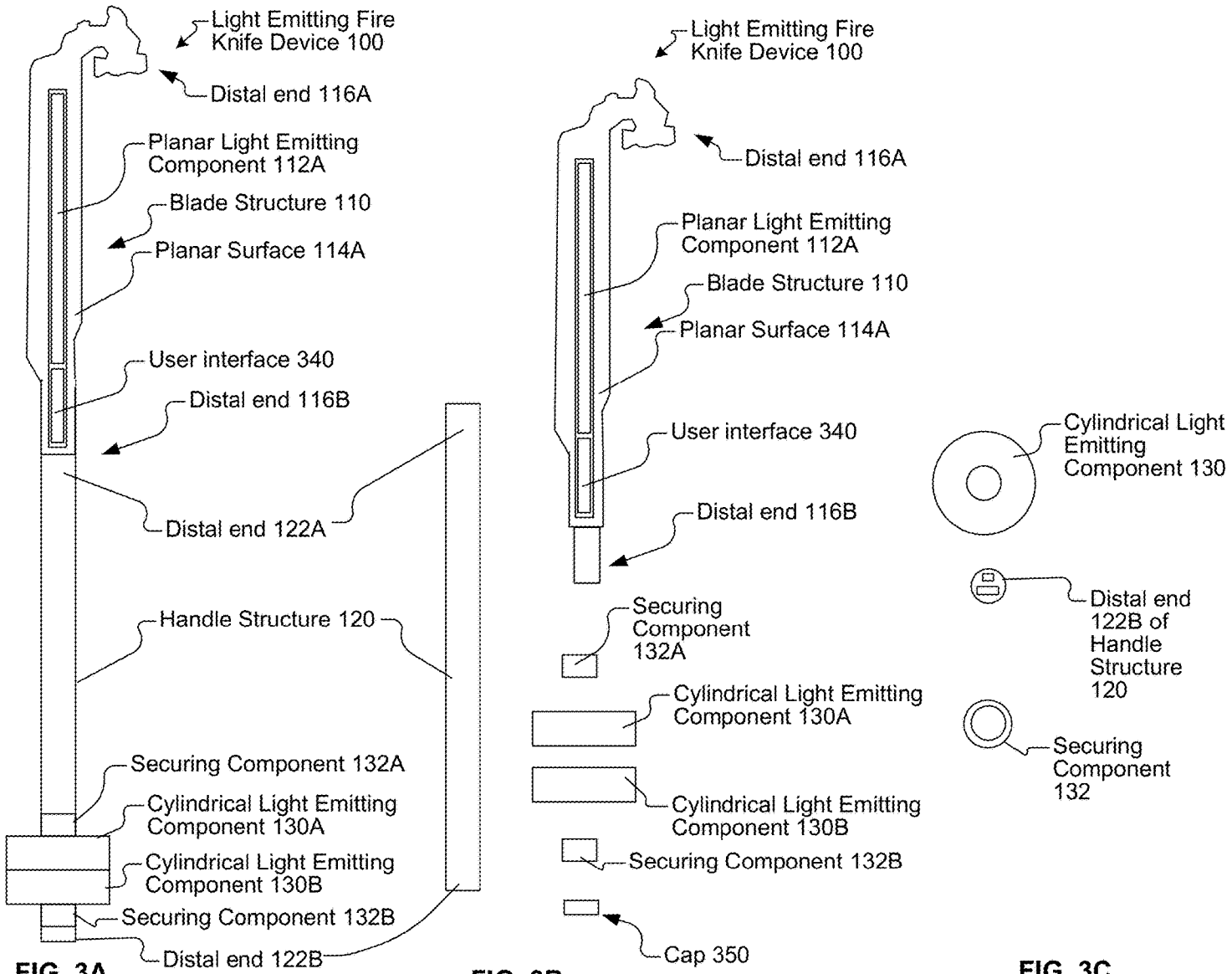
FIGS. 3A-C illustrate light emitting fire knife devices, according to certain embodiments.

FIGS. 3A-C illustrate alight emitting fire knife device 100, according to certain embodiments. FIG. 3A illustrates a front view of an assembled light emitting fire knife device 100. FIG. 3B illustrates a front view of a disassembled light emitting fire knife device 100. FIG. 3C illustrates a bottom view of components of the light emitting fire knife device 100. Features of the light emitting fire knife device 100 of FIGS. 3A-C that have the same or similar numbering as features of the light emitting fire knife device 100 of FIGS. 1A-D may have the same or similarity structure and/or functionality.

The blade structure 110 of the light emitting fire knife device 100 has a distal end 116A (e.g., hook) and a distal end 116B (e.g., electrical connector). The blade structure has a first planar surface 114A and a second planar surface 114B opposite the first planar surface 114A. Each planar surface 114 may form a recess and a corresponding planar light emitting component 112 is disposed in the recess. The planar light emitting component 112 may include a light emitting device (e.g., LED, LED strip lights) and may be covered by a transparent layer (e.g., silicon, clear coat, plastic coat) to protect the light emitting device. The blade structure 110 may include a user interface 340 (e.g., buttons, knobs, switches, etc.). In some embodiments, the user interface 340 and the planar light emitting component 112 are located within the recess. The transparent layer may be disposed on the planar light emitting component 112 and the user interface (e.g., for protection, to prevent from coming off of the blade structure 110, to seal from moisture and/or debris, etc.).

In some embodiments, the blade structure 110 forms an opening from the first planar surface 114A to the second planar surface 114B and a planar light emitting component 112 is disposed (e.g., secured via fasteners, secured via friction fit, etc.) within the opening so that the same planar light emitting component 112 can be viewed from both sides of the blade structure 110).

The blade structure 110 may include a processing device, a battery, and/or a wireless module. The planar light emitting components 112A-B may be coupled to the processing device, user interface 340, and battery via electrical wiring routed within the blade structure 110.

The handle structure 120 may include a first distal end 122A and a second distal end 122B. The first distal end may include an electrical connector configured to connect with the electrical connector of the distal end 116B of the blade structure 110. The distal end 122B may include a charging interface that may be used to charge the battery of the light emitting fire knife device 100 and/or to charge external devices (e.g., smart phone) via the battery of the light emitting fire knife device 100. The distal end 122B and/or user interface may include a power button to turn on and off the light emitting fire knife device 100.

One or more cylindrical light emitting components 130 may be secured around the handle structure using securing components 132A-B. In some embodiments, each cylindrical light emitting component 130 includes a light emitting device (e.g., LED strip lights) disposed within a housing (e.g., transparent housing, semi-transparent housing). Each cylindrical light emitting component 130 may be electrically coupled (e.g., via a connector, via soldering) to electrical wiring routed within the handle structure 120. In some embodiments, one or more of user interface 340 is mounted on the handle structure 120. In some embodiments, processing device, battery, and/or wireless module are disposed within the handle structure 120. In some embodiments, a component (e.g., grommet) is disposed between the cylindrical light emitting component 130 and the handle structure 120 (e.g., to keep the cylindrical light emitting component 130 in place).

In some embodiments, the cylindrical light emitting component 130 has one or more of a user interface (e.g., button, knob, switch, etc.), processing device, wireless module, battery, etc. integral to the cylindrical light emitting component 130. Electrical wiring may not be routed through the handle structure 120, distal end 116B and distal end 122A may not have electrical connectors, and distal end 122B may not have a charging interface. The handle structure 120 may not include electrical components. The blade structure 110 and/or handle structure 120 may include a charging interface. For example, the charging interface may be disposed on the distal end 116B, on a surface of the blade structure 110, or may be via wireless charging (e.g., cordless charging), such as inductive charging (e.g., electromagnetic inductive or non-radiative charging), resonant charging (e.g., radiative electromagnetic resonant charging), and/or radio frequency (RF) charging (e.g., uncoupled RF wireless charging). The wireless charging may be via a charging pad.

The blade structure 110 may be referred to a blade with LED lights and may be made from aluminum, a LED light strip, a LED mini controller (e.g., processing device), and an electrical connector (e.g., 6-pin female connector).

The handle structure 120 may be made from aluminum and may include an electrical connector (e.g., 6-pin male connector). The handle structure 120 may include a charging interface (e.g., charger port, at the distal end 122B) and a power pack (e.g., battery). A cap 350 (e.g., end cap) may be disposed on the distal end 122B to cover the charging interface. The cap 350 may be made of silicone or rubber and may attach around the distal end 122B of the handle structure 120 via a friction fit, a fastener, threading, or the like.

The cylindrical light emitting components 130A-B may be referred to as donut lights and may each include a light emitting device (e.g., LED light strip).

The light emitting fire knife device 100 may have the same or similar design, weight, and dimensions of a traditional Samoan fire knife used in competition. Instead of using a flame, light emitting devices (e.g., LEDs) are used. The light emitting fire knife device 100 may be comfortable to spin, may have a center of gravity that is the same as or similar to that of traditional fire knives (e.g., sides are balanced), may be durable construction, may be visually appealing, may have light emitting devices securely attached to the light emitting fire knife device 100 to operate in multiple color modes and produce a desired effect, may have a user-friendly light controller (e.g., processing device, user interface) that is simple and compact, may easily disassemble for storage and may easily re-assemble for use, may have electrical wiring that is hidden and secure, may have easily-accessible and/or rechargeable batteries, may be sealed to protect from debris, and may be configured to withstand intense spinning and impact from being dropped.

The blade structure 110 is removable from the handle structure 120, is made of a durable material, may have a unique design (e.g., hook may be a hammerhead shark design), and may have a light source (e.g., planar light emitting component 112) on both planar surfaces 114. The unique design of the distal end 116A of the blade structure 110 (e.g., hook, etc.) may be any unique design. The unique design may include one or more of a school name, mascot, professional team, company, and/or the like. The planar light emitting components 112 may be light emitting devices (e.g., LEDs) embedded into the blade structure 110. The light controller (e.g., processing device, user interface) may also be embedded into the blade structure 110. The blade structure 110 may have an electrical connector (e.g., a 6-pin connector) for plug-in power source. The blade structure 110 may be removed from the handle structure 120 without exposing any wiring.

The cylindrical light emitting component 130 may be donut-shaped, may include light emitting device (e.g., LED lighting system), may include or may be coupled to rechargeable or replaceable batteries, and may have a housing that is translucent (e.g., to produce a lighting effect). The charging interface may be protected by a cap 350 that is secured onto the distal end 122B of the handle structure 120. The charging interface and/or the cap 350 may be durable and constructed to withstand impact.

The blade structure 110 may be made from aluminum with a flush-mounted LED strip and a flush-mounted user interface (e.g., controller). The blade structure 110 may be made out of any hard material including one or more of carbon, other metals, plastics, etc.

The power source (e.g., battery) may be permanently impeded into the lower end of the handle and may power both the planar light emitting components 112A-B and the one or more cylindrical light emitting components 130 at the same time (e.g., simultaneously, concurrently). The light emitting devices of the planar light emitting components 112A-B and the one or more cylindrical light emitting components 130 may be operated in synchronization with each other. The power source may be a rechargeable battery that charges using a USB-charging port located at the distal end 122B for easy access. The charging port may include a USB Type-C port to charge additional devices (e.g., smart phone, etc.). The charging ports may be protected by a cap 350 (e.g., clear end cap) that has a friction fit (e.g., snuggly fits) onto the distal end 122B of the handle structure 120 and protects from debris and impacts.

The handle structure 120 may secure to the blade structure 110 via one or more fasteners (e.g., two Allen screws) that go through the handle structure 120 and attach to a side surface of the distal end 116B of the blade structure 110. A first fastener (e.g., first Allen screw) may be closest to the blade of the blade structure 110 and may hold the blade structure 110 in place. The second fastener (e.g., second Allen screw) secure the handle structure 120 to the electrical connector (e.g., male end of the electrical connector, connection point) of the handle structure 120 to hold the electrical connector in place and the second fastener may not accessible to the user for removal. In some embodiments, two or more fasteners (e.g., a first and second set screws opposite each other) may be used on the handle to hold the electrical connector in place.

Each cylindrical light emitting component 130 may be secured to the handle structure 120 (e.g., held in place) with a corresponding fastener (e.g., an Allen screw) located on the inside of the cylindrical light emitting component 130.

The blade structure 110 and handle structure 120 that completely remove from each other may not expose wires and may easily disassemble for storage, travel, and to fit into a suitcase. The planar light emitting component 112 and user interface may sit flush with the blade and may be covered with a protective clear layer.

Figure 4D:
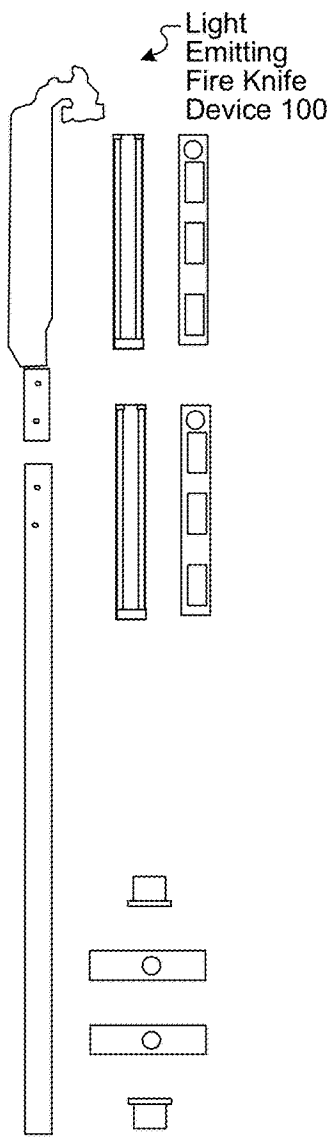
FIGS. 4A-D illustrate light emitting fire knife devices, according to certain embodiments.
Figure 4C:
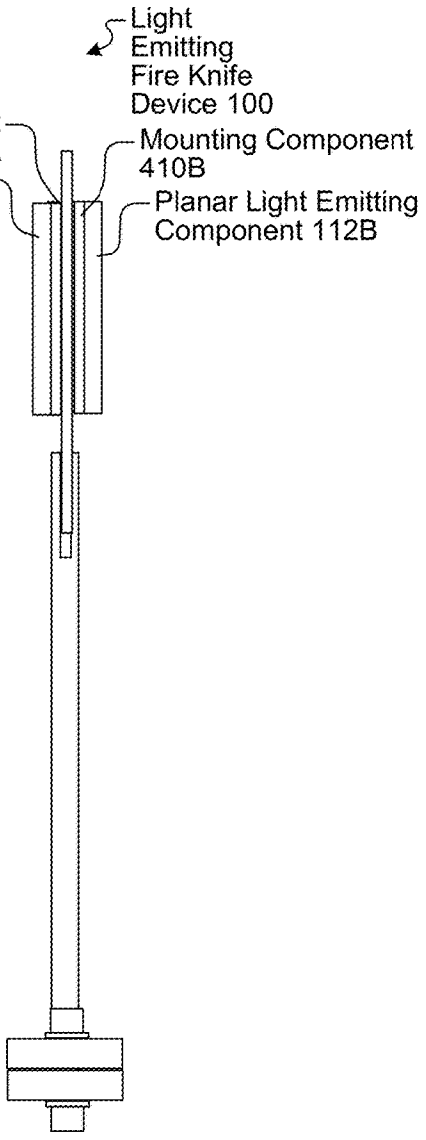
Figure 4B:
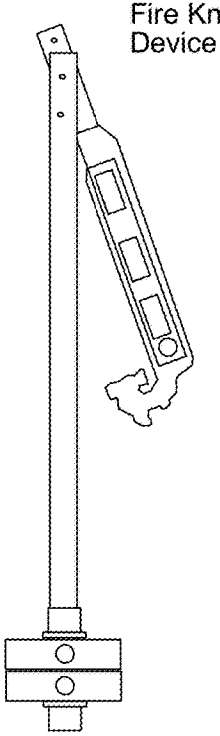
Figure 4A:
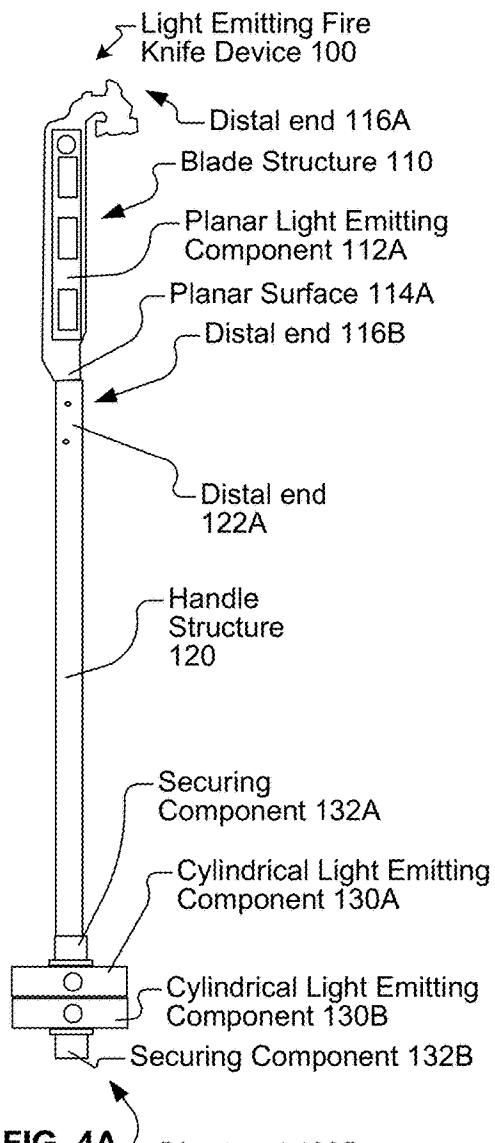

FIGS. 4A-D illustrate light emitting fire knife devices 100, according to certain embodiments. FIG. 4A illustrates a front view of an assembled light emitting fire knife device 100. FIG. 4B illustrates a front view of a folded light emitting fire knife device 100. FIG. 4C illustrates a rear view of an assembled light emitting fire knife device 100. FIG. 4D illustrates a front view of a disassembled light emitting fire knife device 100. Features of the light emitting fire knife device 100 of FIGS. 4A-D that have the same or similar numbering as features of the light emitting fire knife device 100 of FIGS. 1A-D and/or FIGS. 3A-C may have the same or similarity structure and/or functionality.

Light emitting fire knife device 100 of FIGS. 4A-D has a blade structure and a handle structure 120 that are coupled to each other. In one state, the blade structure and the handle structure 120 are secured in an un-folded position and are to remain that position during fire dancing. In another state, the blade structure 110 and the handle structure 120 are in a folded state (e.g., see FIG. 4B).

A mounting component 410 (e.g., track system) is mounted (e.g., via fasteners) onto each planar surface 114 of the blade structure 110. A planar light emitting component 112 (e.g., block light) is secured to the blade structure 110 via the mounting component 410. The top track of the planar light emitting component 112 may slide snuggly into the bottom track of the mounting component 410. The planar light emitting component 112 secured to the mounting component 410 may have approximately the same dimensions as fireboard used on traditional fire knives with actual fire.

The planar light emitting component 112 may be removed from the blade structure 110 to replace and/or recharge batteries. The light emitting devices in the planar light emitting component 112 may be LED track lights. The planar light emitting component 112 may include multiple sets of light emitting devices (e.g., three sets of three light emitting devices) and a user interface.

One or more cylindrical light emitting components 130 are secured to the handle structure 120. Each cylindrical light emitting component 130 may have an integral battery (e.g., battery-operated pack), integral light emitting devices (e.g., LEDs), and a user interface (e.g., push button, button soft to the touch, easy to turn on and off) to control the light emitting devices. In some embodiments, the batteries are removable from the cylindrical light emitting component 130 and/or are rechargeable. In some embodiments, the cylindrical light emitting component 130 is to be replaced once the battery runs out.

The blade structure 110 may have a hook at the distal end 116A. The hook may have a unique design (e.g., a unique hammerhead shark design). The blade structure 110 may have a planar light emitting component 112 secured to each the first and second planar surfaces 114 (e.g., double sided block lights). The blade structure 110 may have openings (e.g., drill holes) for foldability and attachment to the handle structure 120. The first opening (e.g., drill hole) may be configured to receive a non-removable fastener (e.g., non-removable locking screw) and the second opening may be configured to receive a removable fastener (e.g., removable screw) used for folding the light emitting fire knife device 100.

The planar light emitting component 112 may have different light emitting device (e.g., LED) colors layered under a transparent or translucent material (e.g., silicon, etc.) to act as a protective bumper case that can withstand high impact drops and is translucent enough to allow the light to be emitted from the planar light emitting component 112. The planar light emitting component 112 may have a push button to operate the light emitting devices (e.g., LEDs) and change color modes. The planar light emitting component 112 may be operated by batteries (e.g., cell batteries). The planar light emitting component 112 may resemble (e.g., through the use of light emitting devices) block burn pads of a traditional Samoan fire knife. The bottom of the top track of the planar light emitting component 112 may have an access panel (e.g., below the push button that operates the light emitting devices) and may have fasteners (e.g., screws) used to access the one or more batteries for replacement.

In some embodiments, the planar light emitting components 112A-B may be removed from the blade structure 110 (e.g., the mounting components 410A-B may also be removed from the blade structure 110) and block burn pads may be attached to the blade structure 110 via metal wiring for use of the light emitting fire knife device 100 with actual fire. In some embodiments, the cylindrical light emitting components 130A-B may be removed from the handle structure 120 (e.g., the securing components 132A-B may also be removed from the handle structure 120) and donut burn pads may be attached to the handle structure 120 via metal wiring for use of the light emitting fire knife device 100 with actual fire. The planar light emitting component 112 coupled to a mounting component 410 may be approximately the same size as a block burn pad. The cylindrical light emitting component 130 may be approximately the same size as a donut burn pad.

The light emitting fire knife device 100 may have dimensions that are similar to dimensions of a traditional Samoan fire knife. The actual dimensions may vary. The full length of the light emitting fire knife device 100 may be about 36.1875 inches (in) (3' 3/16"). The total weight of the light emitting fire knife device 100 may be about 1 pounds (lb) 11 ounces (oz). The blade structure 110 of the light emitting fire knife device 100 may be about 15.5 in (1' 3.5") long and about 0.125 in thick. The shaft of the blade structure 110 may be about 1.75 in thick. The blade width of the hook may be about 4.1875 in. The blade length that inserts into the handle structure 120 may be about 3.375 in.

The planar light emitting component 112 (e.g., block light) may be about 8 in long, 1.5 in wide, and may have a height (including the mounting component 410) of about 0.9375 in.

The handle structure 120 may have an outer diameter of about 1 in, a length without cap 350 of about 24 in, and a length including the cap 350 of about 24.3125 in. The distal end 122A to top of the opening for the first fastener (e.g., first screw to attach the handle structure 120 to the blade structure 110) of about 1.3125 in, distal end 122A to top of the opening for the second fastener (e.g., second screw to attach the handle structure 120 to the blade structure 110) of about 2.875 in. The handle structure 120 may have a cutout length of about 4.1875 and may have a gap between the blade structure 110 and the bottom of the cutout in the handle structure 120 of about 0.8125 in.

The cap 350 may have a length of 1 to 1.5 in. The handle structure 120 may have a distance of about 0.5 in from the distal end 122B to the start of an opening (e.g., a pin hole).

The cylindrical light emitting component 130 may have an outer diameter of about 3 in, a thickness of about 0.75 in, and a thickness of two cylindrical light emitting components 130 of about 1.5 in.

Figure 4E:
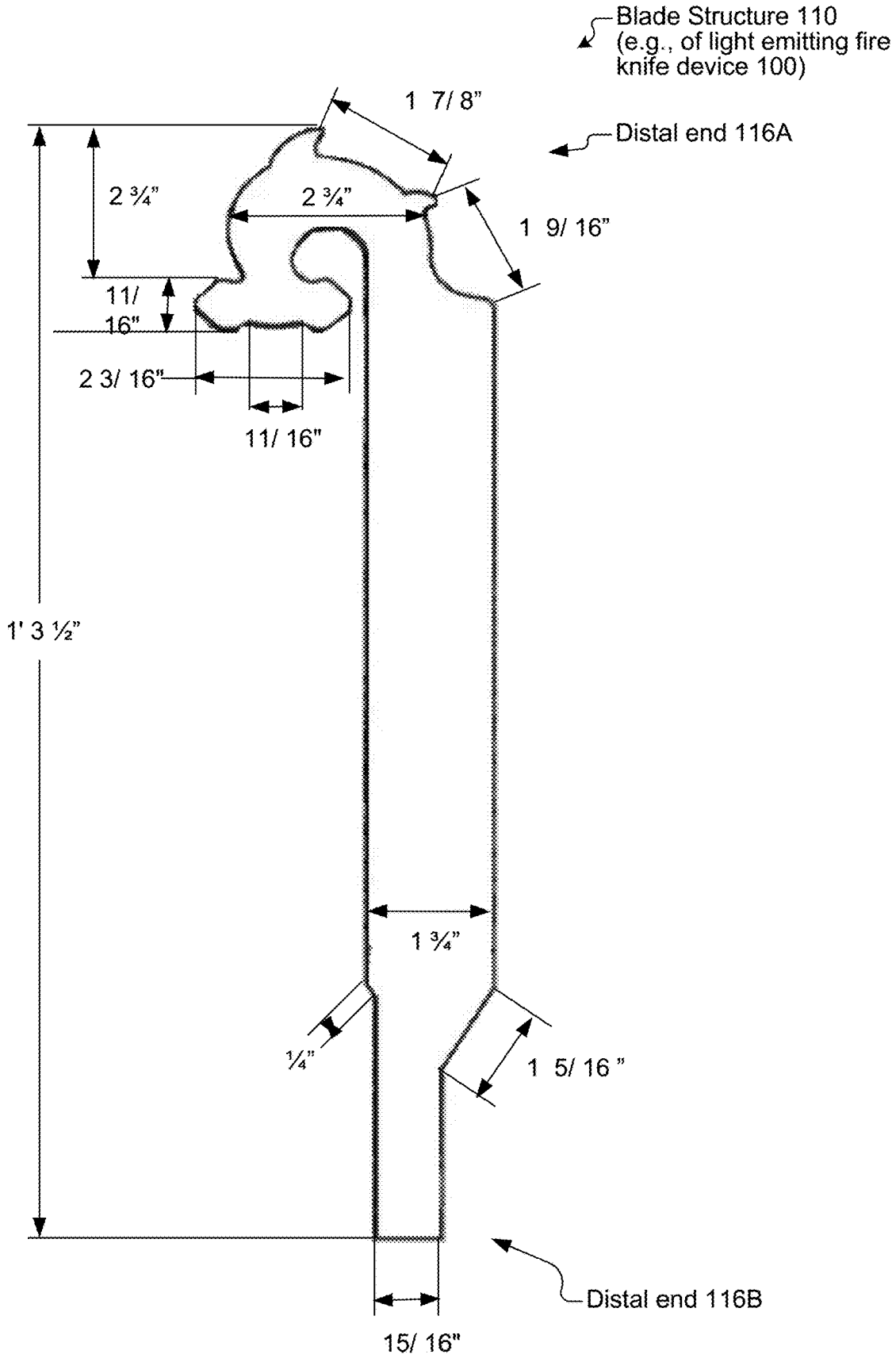
FIGS. 4E-K illustrate components of light emitting fire knife devices, according to certain embodiments.
Figures 4F, 4G, 4H:
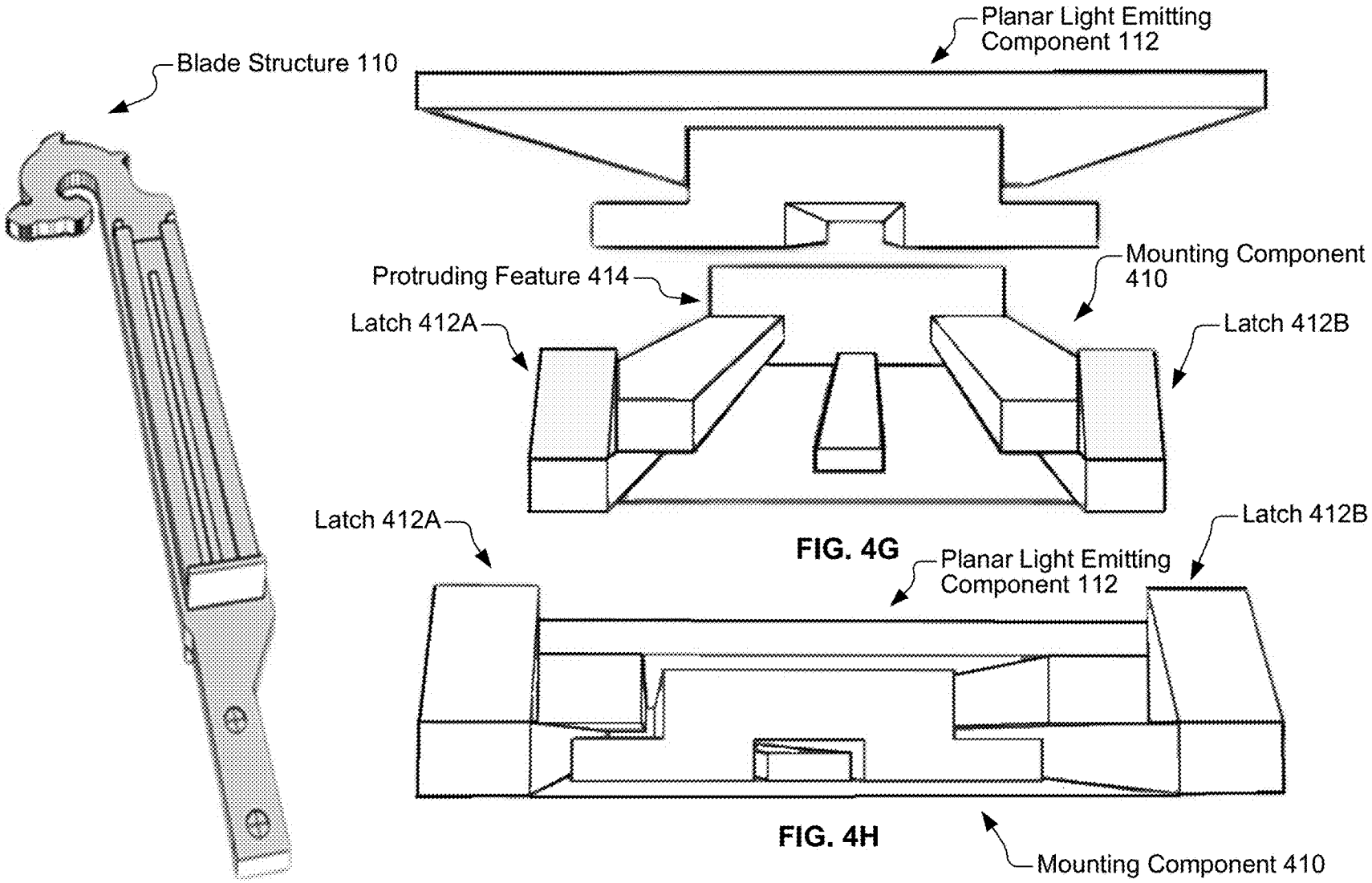
Figure 4I:
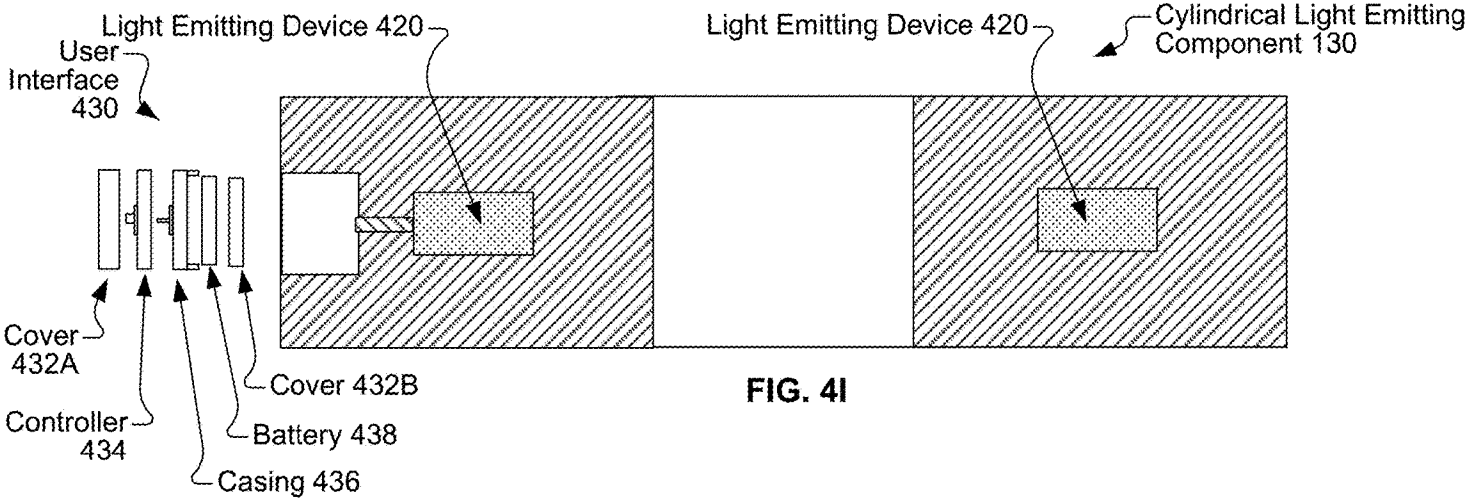
Figure 4J:
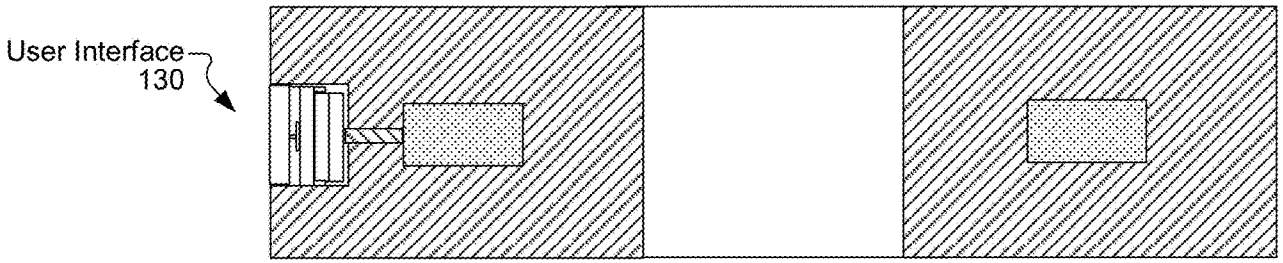
Figure 4K:
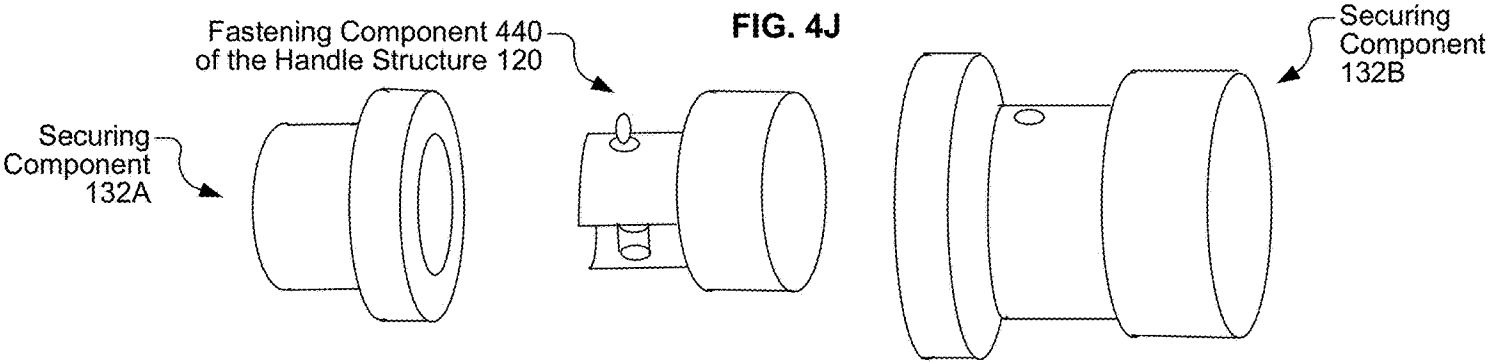
Figure 5B:
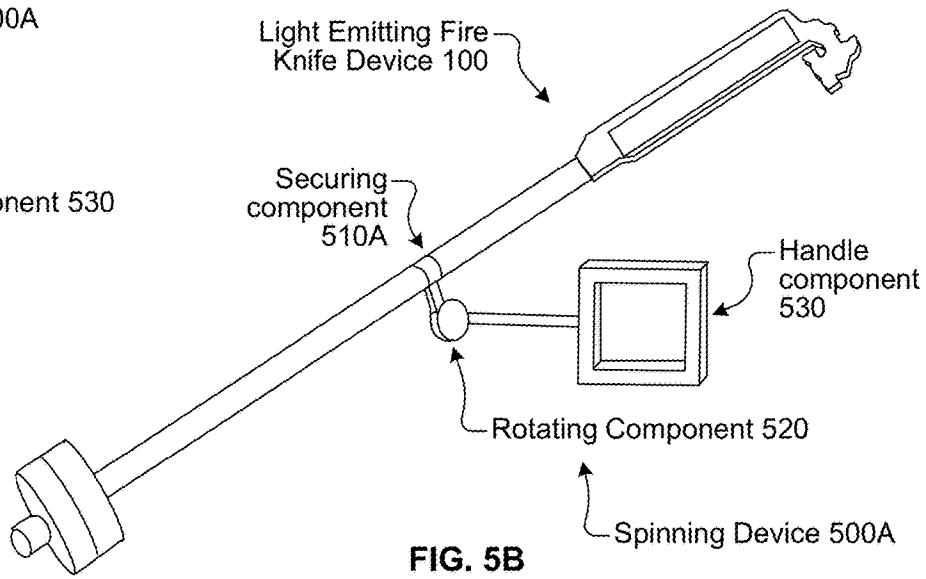
FIGS. 5A-D illustrate spinning devices associated with light emitting fire knife devices, according to certain embodiments.
Figure 5A:
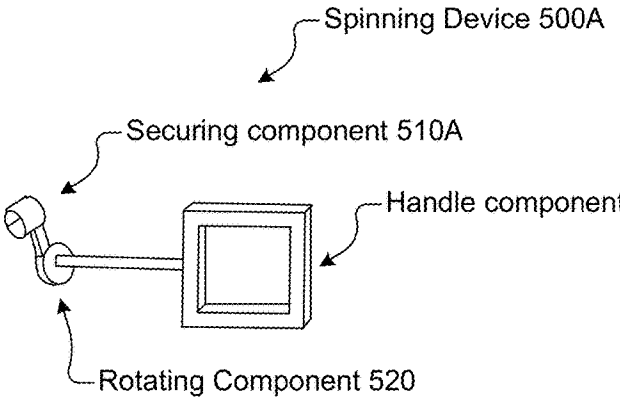
Figure 5D:
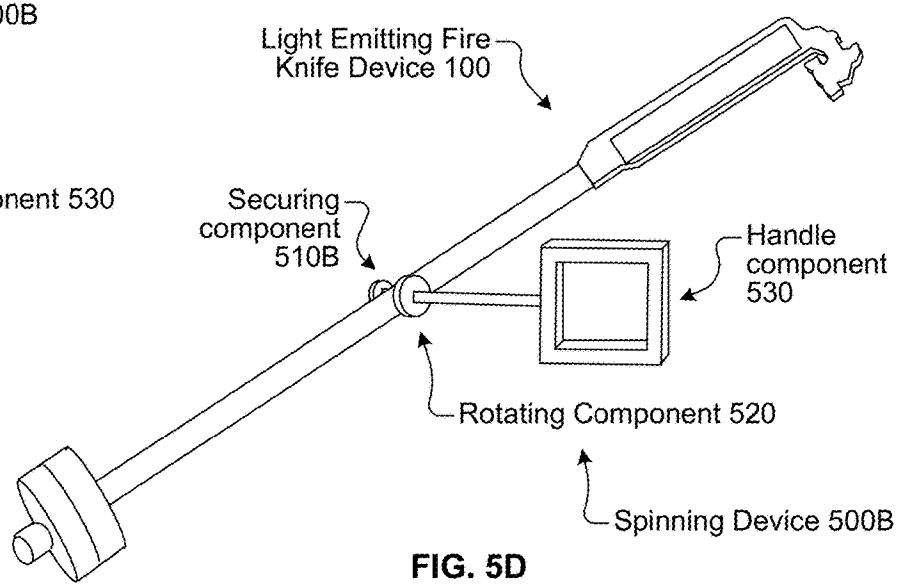
Figure 5C:
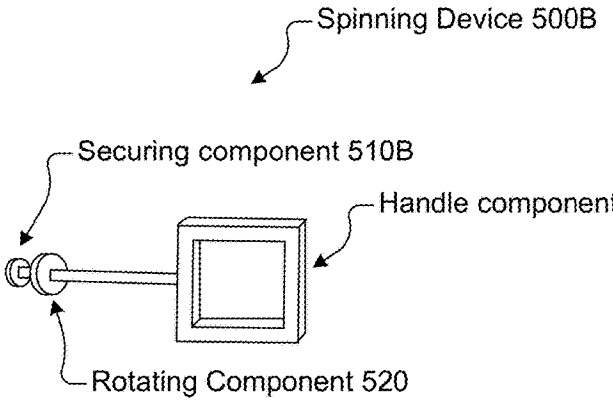

FIGS. 4E-K illustrate components of light emitting fire knife devices 100, according to certain embodiments. FIG. 4E illustrates a blade structure 110 of a light emitting fire knife device 100. FIG. 4F illustrates a blade structure 110 and mounting component 410 of a light emitting fire knife device 100. FIG. 4G-H illustrate a mounting component 410 and a portion of a planar light emitting component 112 of a light emitting fire knife device 100. FIG. 4I-J illustrate a cylindrical light emitting component 130 of a light emitting fire knife device 100. FIG. 4K illustrates securing components 132A-B of a light emitting fire knife device 100. Features of the components of light emitting fire knife devices 100 of FIGS. 4E-K that have the same or similar numbering as features of the light emitting fire knife devices 100 of FIGS. 1A-D, FIGS. 3A-C, and/or FIGS. 4A-D may have the same or similarity structure and/or functionality.

FIG. 4E illustrates exemplary dimensions of the blade structure 110. In some embodiments, one or more of the dimensions of the blade structure 110 may be substantially similar (or the same as) to one or more of the dimensions shown in FIG. 4E. In some embodiments, one or more of the dimensions of the blade structure 110 are within 5% of one or more of the dimensions shown in FIG. 4E. In some embodiments, one or more of the dimensions of the blade structure 110 are within 10% of one or more of the dimensions shown in FIG. 4E. In some embodiments, one or more of the dimensions of the blade structure 110 are within 20% of one or more of the dimensions shown in FIG. 4E. In some embodiments, two or more of the dimensions of the blade structure 110 have the same ratio as two or more of the dimensions shown in FIG. 4E.

FIG. 4F illustrates a blade structure 110 and a mounting component 410 of alight emitting fire knife device 100. In some embodiments, the mounting component 410 is removably attached to the blade structure 110 (e.g., via one or more fasteners, such as one or more bolt, a screw, etc.). In some embodiments, the mounting component 410 is non-removably attached to the blade structure 110 (e.g., via welding, etc.).

FIG. 4G-H illustrate a mounting component 410 and a portion of a planar light emitting component 112 of a light emitting fire knife device 100. The mounting component 410 may have first features (e.g., recess, channel, etc.) that couple together with second features (e.g., protrusions) of the planar light emitting component 112.

The mounting component 410 and the planar light emitting component 112 may forma full track system including a top track (e.g., of the light emitting component 112) and a bottom track (e.g., of the mounting component 410) inserted into each other. The mounting component 410 may secure the planar light emitting component 112 to the blade structure 110 during use (e.g., twirling, throwing, catching, etc.). The mounting component 410 may release the planar light emitting component 112 without the use of tools. The top track of the planar light emitting component 112 may slide into the bottom track of the mounting component 410. The mounting component may have one or more latches 412 (e.g., pushdown/pop-up latches) that are pushed down during sliding the top track into the bottom track. Once the top track has passed the one or more latches 412, the one or more latches may extend to secure the top track from sliding off the mounting component 410. The latches 412 may include material (e.g., pliable material) and/or a component (e.g., coil spring) that acts as a spring so that the latches 412 may be in a first position (e.g., push-down position) to receive and to release the top track and then in a second position (e.g., pop-up position, extended position) to secure the top track. The push-down position may not be activated by use (e.g., twirling, throwing, catching, etc.) of the light emitting fire knife device 100. The push-down position may be activated by sliding the top track into the bottom track or a release action (e.g., manually pushing down both latches 412, etc.). In some embodiments, the latches 412 secure the top track until a tool is used to release the top track. A protruding feature 414 (e.g., back stopper) may keep the top track from sliding off the other side (e.g., opposite the latches 412) of the mounting component 410.

FIG. 4I-J illustrate cross-sectional front views of a cylindrical light emitting component 130 of a light emitting fire knife device 100. FIG. 4 illustrates an exploded cross-sectional front view and FIG. 4J illustrates an assembled cross-sectional front.

The distal end 122B of the handle structure 120 be configured to receive one or more cylindrical light emitting components 130 and securing components 132 (e.g., end stoppers). The cylindrical light emitting components 130 (e.g., donut lights) may include (e.g., may be made of) a translucent material (e.g., silicon, etc.) that is capable of withstanding high impact drops. The cylindrical light emitting component 130 may include designs and/or text (e.g., Sulu Vii, "Torch of the islands") on or embedded in the translucent housing. The cylindrical light emitting components 130 may include any unique text (e.g., on or embedded in the translucent housing), where the unique text may include one or more of a company logo, a school identifier (e.g., name, mascot, etc.), a sports team identifier (e.g., name, mascot, etc.), etc.

The translucent material may house one or more light emitting devices 420 (e.g., LEDs, circular multi-colored LEDs, LED strip). The light emitting device 420 may include a ring of LEDs that is within the cylindrical light emitting component 130 and circles around the channel through the cylindrical light emitting component 130 (e.g., circles around the handle structure 120 responsive to the cylindrical light emitting component 130 being disposed around the handle structure 120). In some embodiments, the light emitting device 420 is embedded within material (e.g., silicon) of the cylindrical light emitting component 130. In some embodiment, the cylindrical light emitting component 130 includes a housing (e.g., made of silicon) that forms a chamber and the light emitting device 420 is disposed within the chamber (e.g., to be disposed around the handle structure 120).

The light emitting devices 420 used for the planar light emitting component 112 and/or the cylindrical light emitting component 130 may be one or more of weather resistant, water proof, water resistant, sunlight resistant, have different colors (e.g., red, blue, green, and white), or the like The cylindrical light emitting component 130 may include a user interface 430 (e.g., a push button) to control one or more of the activation, the one or more colors, the one or more patterns, the one or more intensities, the one or more speeds, and/or the like of the light emitting device. A user interface 430 (e.g., one or more push-buttons, push-button assembly, etc.) may be coupled to the light emitting device 420. The user interface 430 may receive user input (e.g., pushing of a button, turning of a knob, receiving of a wireless signal, receiving user input through a graphical user interface, etc.) to control the light emitting device 420.

The user interface 430 may include one or more of a cover 432A, a controller 434 (e.g., push button/operating board, processing device), a casing 436, one or more batteries 438, and/or a cover 432B. In some embodiments, responsive to user input pushing the cover 432A, the cover 432A pushes against a portion of the controller 434 that extends from the planar portion of the controller 434 to actuate the controller 434, and the actuated controller 434 may control the light emitting device 420. The casing 436 may have a one or more first features on the front of the casing 436 that secures to the controller 434 and one or more second features that secure against the battery 438 and/or cover 432B.

The user interface 430 (e.g., push button) that operates the cylindrical light emitting component 130 may include a removable component that provides access to the one or more batteries 438 for replacement. In some embodiments, the user interface 430 is removably attached to the cylindrical light emitting component 130. One or more components of the user interface 430 may be removed from the cylindrical light emitting component 130 to replace the one or more batteries 438. The user interface 430 may remain secured (e.g., fastened via one or more fasteners (e.g., a screw, bolt, etc.), threading, friction fit, etc.) to the cylindrical light emitting component 130 during use (e.g., twirling, throwing, catching, etc.) of the light emitting fire knife device 100. In some embodiments, the user interface 430 is integral to (e.g., not removable from) the cylindrical light emitting component 130.

FIG. 4K illustrates securing components 132A-B of a light emitting fire knife device 100. The securing components 132A-B may be constructed of a pliable material (e.g., rubber, etc.). The securing component 132A may be used to prevent the one or more cylindrical light emitting components 130 from sliding up the handle structure 120. The securing component 132B may be used as an end stopper to keep the one or more cylindrical light emitting components 130 from sliding off the handle structure 120. The securing components 132A-B may secure the cylindrical light emitting components 130 onto the handle structure 120 (e.g., prevent movement of the cylindrical light emitting components 130 relative the handle structure 120). The securing component 132A may provide a friction fit onto the handle structure 120 and may be moved with extra effort to accommodate extra cylindrical light emitting components 130 (e.g., two or more, more than two, etc.) on the handle structure 120. The securing component 132B may securely latch to the distal end 122B through fasteners (e.g., a double set of push-in pins) that pop into openings (e.g., preset drilled holes) on the handle structure 120. In some embodiments, the handle structure 120 includes a fastening component 440 that couples to the handle structure 120 and to the securing component 132B.

The securing component 132A may be moved to a first location on the handle structure 120 (e.g., by pushing the securing component 132A onto the handle structure 120 from the distal end 122B partially towards the distal end 122A). The fastening component 440 may be secured to the distal end 122B of the handle structure 120 after the securing component 132A is moved to the first location on the handle structure 120. The fastening component 440 may be secured to the distal end 122B of the handle structure 120 via one or more of fasteners (e.g., push pins), threading, friction fit, etc. The securing component 132B may be secured to the fastening component 440 and/or the handle structure 120 via one or more of fasteners (e.g., push pins, the same push pins that fasten the fastening component 440 to the handle structure 120), threading, friction fit, etc.

FIGS. 5A-D illustrate spinning devices 500 associated with light emitting fire knife devices 100, according to certain embodiments. A fire knife system may include a spinning device 500 and a fire knife device (e.g., a light emitting fire knife device 100, a fire knife device 200, etc.). The spinning device 500 may be used with one or more of the light emitting fire knife devices 100 of FIGS. 1A-D, 3A-B, 4A-D, 5B, and/or 5D and/or with one or more of the fire knife devices 200 of FIGS. 2A-G.

The spinning device 500 may assist users of various skill abilities to learn how to spin a light emitting fire knife device 100 (e.g., and/or a fire knife device 200, and/or a traditional fire knife, and/or another type of spinning device). The spinning device 500 includes a securing component 510 (e.g., clap, fastener, bolt, etc. to removably secure to the handle structure 120), a rotational component 520, and a handling component 530. The spinning device 500 may be removably attached to the handle structure 120. In some embodiments, the spinning device 500 secures to (e.g., clamps on and off of) the handle structure 120 proximate the center of gravity (COG) of the light emitting fire knife device 100. The spinning device 500 may be used to smoothly spin and swivel the light emitting fire knife device 100 in multiple directions and rotations without pinch points.

In some embodiments, the securing component 510A and the rotational component 520 form a removable swivel clamp device that removably clamps to the handle structure 120.

In some embodiments, the spinning device 500B forms a rod and bearing system that inserts through the handle structure 120 at the COG of the handle structure 120 and is secured by a fastener (e.g., securing component 510B, locking bolt). To insert the spinning device 500B, one or more of the securing component 510B, the rotational component 520, and/or the handling component 530 is removed from the spinning device 500B, the spinning device 500B (e.g., a rod of the spinning device 500B) is inserted through the handling component 530, and the one or more of the securing component 510B, the rotational component 520, and/or the handling component 530 are secured to the spinning device 500B. The spinning device 500B may be inserted through a channel (e.g., sleeve) through the handle structure 120. The channel may have a sleeve, where any wires routed through the handle structure 120 are routed around the sleeve through the handle structure 120.

The rotational component 520 may include a machine element (e.g., bearing, ball bearing) that constrains relative motion to a particular (e.g., motion around a fixed axis, such as a fixed central axis of the rotational component 520, a fixed central axis of the rod of the spinning device 500B that connects the handling component 530 to the rotational component 520) and reduces friction between moving parts. The rotational component 520 may allow the spinning device 500 (e.g., rod of the spinning device 500) to rotate a full 360 degrees.

The spinning device 500 may be used to spin the light emitting fire knife in the clockwise and counter-clockwise directions.

The handling component 530 may be a structure that may be gripped by and/or secured to a user (e.g., a user's hand). The handling component 530 may include handle bars, a steering wheel, a handle with a grip sized for a user's hand, or the like. The handling component 530 may include a shaft (e.g., rod, cylindrical structure) that has first and second distal ends opposite of each other, where the first distal end is secured to a gripping device (e.g., to be secured by a hand of a user) and the second distal end is secured to the rotational component 520.

Figure 6:
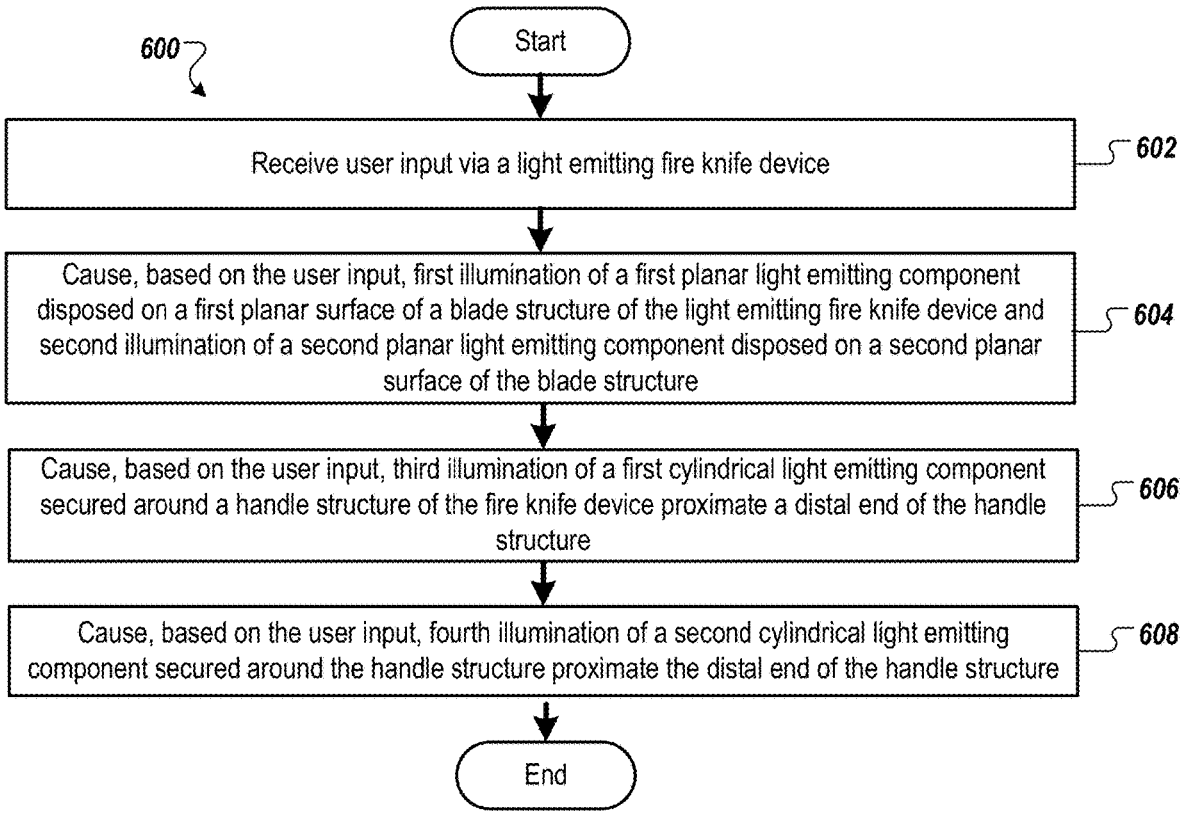
FIG. 6 illustrates a method for operating a light emitting fire knife system, according to certain embodiments.

FIG. 6 illustrates a method for operating a light emitting fire knife device 100, according to certain embodiments. The method 600 can be performed by processing logic that can include hardware (e.g., processing device, circuitry, dedicated logic, programmable logic, microcode, hardware of a device, integrated circuit, etc.), software (e.g., instructions run or executed on a processing device), or a combination thereof. In some embodiments, the method 600 is performed by a processing device of one or more of the light emitting fire knife device 100, one or more planar light emitting components 112, one or more cylindrical light emitting components 130, and/or the like. Although shown in a particular sequence or order, unless otherwise specified, the order of the processes can be modified. Thus, the illustrated embodiments should be understood only as examples, and the illustrated processes can be performed in a different order, and some processes can be performed in parallel. Additionally, one or more processes can be omitted in various embodiments. Thus, not all processes are required in every embodiment. Other process flows are possible.

Referring to FIG. 6, at block 602, the processing logic (e.g., processing device) receives user input via a light emitting fire knife device 100. The light emitting fire knife device 100 may include a blade structure 110 and a handle structure 120. The blade structure 110 includes a first distal end 116A and a second distal end 116B opposite the first distal end 116A. The handle structure 120 includes a third distal end 122A and a fourth distal end 122B opposite the third distal end 122A. The third distal end 122A of the handle structure 120 is removably secured to the second distal end 116B of the blade structure 110.

In some embodiments, the user input is received via a user interface of the light emitting fire knife device 100. The user interface may be located on the blade structure 110, the handle structure 120, and/or each planar light emitting component 112. In some embodiments, the user input is received via a wireless module of the light emitting fire knife device 100 from a user device (e.g., remote, smart phone, computer, etc.).

At block 604, the processing logic causes, based on the user input, first illumination of a first planar light emitting component 112A disposed on a first planar surface 114A of the blade structure 110 and second illumination of a second planar light emitting component 112B disposed on a second planar surface 114B of the blade structure 110. The first planar surface 114A is opposite the second planar surface 114B.

At block 606, the processing logic causes, based on the user input, third illumination of a first cylindrical light emitting component 130A secured around the handle structure 120 proximate the fourth distal end 122B of the handle structure 120.

At block 608, the processing logic causes, based on the user input, fourth illumination of a second cylindrical light emitting component 130B secured around the handle structure 120 proximate the fourth distal end 122B of the handle structure 120.

In some embodiments, the processing logic controls two or more of the first illumination of the first planar light emitting component 112A, the second illumination of the second planar light emitting component 112B, the third illumination of the first cylindrical light emitting component 130A, and/or the fourth illumination of the second cylindrical light emitting component 130B to be substantially the same and/or substantially simultaneously. For example, the processing logic may control two or more of the first planar light emitting component 112A, the second planar light emitting component 112B, the first cylindrical light emitting component 130A, and/or the second cylindrical light emitting component 130B to be substantially the same colors, sequence, speed, intensity, etc. at substantially the same time. In some embodiments, the processing logic controls one or more of the first illumination of the first planar light emitting component 112A, the second illumination of the second planar light emitting component 112B, the third illumination of the first cylindrical light emitting component 130A, and/or the fourth illumination of the second cylindrical light emitting component 130B to be synchronized with other lights (e.g., other light emitting fire knives 110), fire dance movements (e.g., of a choreographed fire dance), and/or music.

In some embodiments, the processing logic is paired with a user device (e.g., smart phone, computer, user account, remote control, a component embedded in the light emitting fire knife device 100, etc.). In some embodiments, the processing logic is located within the user device. In some embodiments, the processing logic is located with the blade structure 110. In some embodiments, the processing logic is disposed within the handle structure 120. In some embodiments, each of the first planar light emitting component 112A, the second planar light emitting component 112B, the first cylindrical light emitting component 130A, and/or the second cylindrical light emitting component 130B have their own processing logic.

In some embodiments, one or processing devices associated with the light emitting fire knife device 100 (e.g., processing device of the light emitting fire knife device, processing device of the first planar light emitting component 112A, processing device of the second planar light emitting component 112B, processing device of the first cylindrical light emitting component 130A, and/or processing device of the second cylindrical light emitting component 130B) are paired with a user device associated with a user account.

Each of the one or more processing devices and the user device may exchange keys (e.g., via a key exchange, via securely exchanging cryptographic keys over a public channel, public-key exchange, or the like). For example, a key associated with the user device (e.g., associated with a user account associated with the user device) may be transmitted to and stored in memory coupled to the processing device. The user device may encode a control signal using the key to generate an encoded control signal and transmit the encoded control signal to the processing device. The processing device may decode the encoded control signal using the key and may use the decoded control signal to control the corresponding one or more light emitting devices. The processing device may encode a response to the control signal using the key by generating an encoded response, transmit the encoded response, and transmit the encoded response to the user device. The user device may decode the encoded response using the key and may determine that the one or more light emitting devices are emitting light based on the decoded response. In some embodiments, the user device determines an error in the light emitting devices based on the decoded response. In some embodiments, the user device periodically transmits the encoded control signal until determining the light emitting devices are emitting light based on the decoded response.

In some embodiments, the one or more processing devices and the user device may be set to the same frequency, the user device transmits control signals over that frequency, and the one or more processing devices receive the control signals over that frequency.

In some embodiments, one or more of the first planar light emitting component 112A, the second planar light emitting component 112B, the first cylindrical light emitting component 130A, and/or the second cylindrical light emitting component 130B may be added to the light emitting fire knife device 100 (e.g., to replace other light emitting components or to be in addition to existing light emitting components). Upon adding new light emitting components, the new light emitting components may be paired with the user device (e.g., by exchanging keys and/or being set to the same frequency).

In some embodiments, each control signal includes instructions of which one or more light emitting devices are to be controlled based on the control signal and how each of the one or more light emitting devices are to be controlled (e.g., one or more colors, sequence, intensity, etc.). In some embodiments, each light emitting device is paired using a different key (e.g., only the light emitting device for which the control signal is intended has the key to decode the encoded control signal).

By exchanging keys and/or being set to the same frequency, one or more light emitting devices may be controlled separately from one or more other light emitting devices. For example first and second light emitting fire knife devices 100 may be used in a fire dance and each light emitting fire knife device 100 may be paired using different keys to control the first and second light emitting fire knife devices 100 separately.

Figure 7:
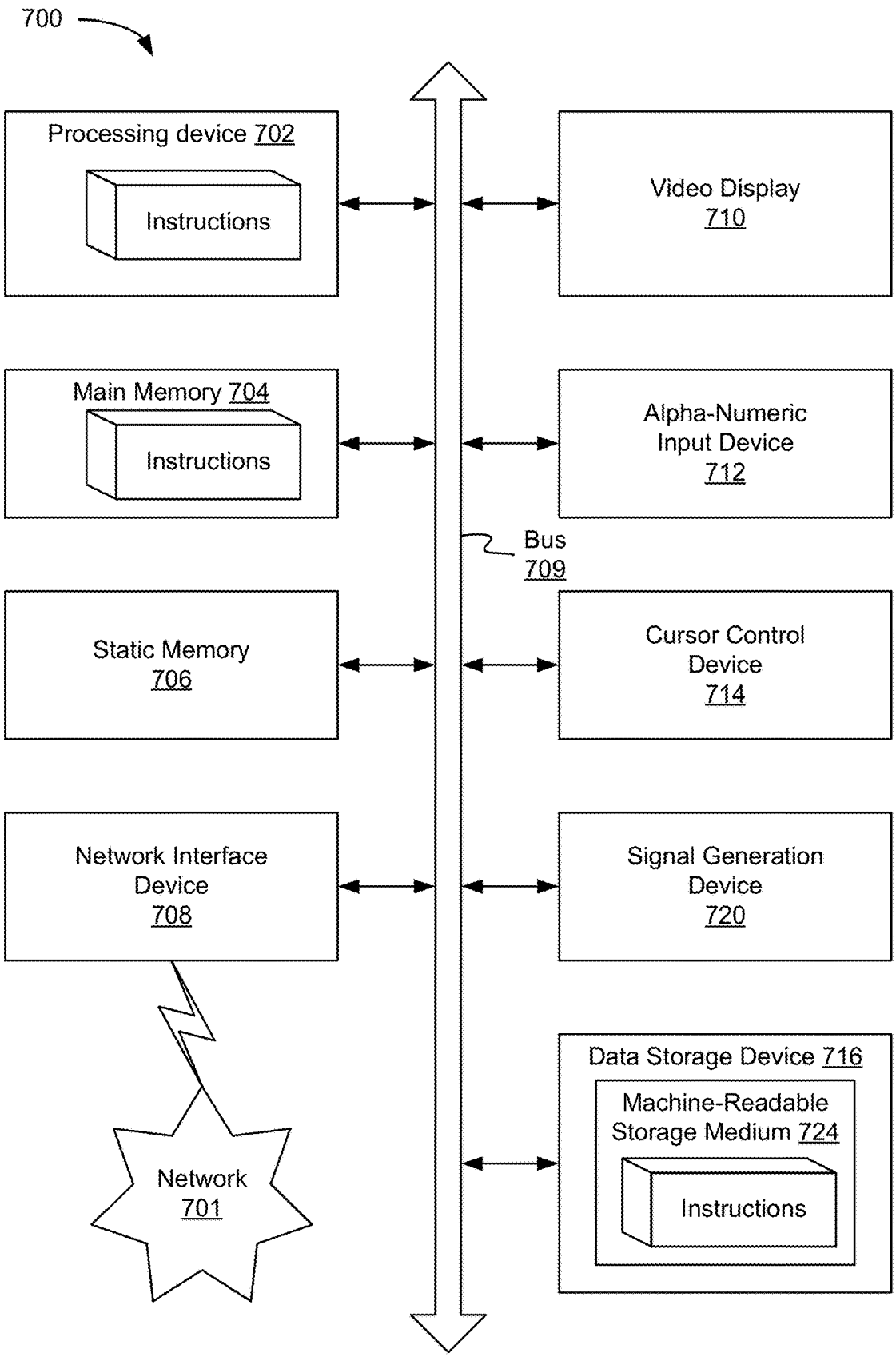
FIG. 7 illustrates a diagrammatic representation of a machine in the example form of a computer system including a set of instructions executable by a computer system to operate a light emitting fire knife device according to any one or more of the methodologies discussed herein.

FIG. 7 illustrates a diagrammatic representation of a machine in the example form of a computer system 700 including a set of instructions executable by a computer system to operate a light emitting fire knife device 100 according to any one or more of the methodologies discussed herein. In some embodiments, computer system 700 is one or more of a light emitting fire knife device 100, a planar light emitting component 112, a cylindrical light emitting component 130, and/or a user device. The computer system 700 may have more or less components than those shown in FIG. 7. In one embodiment, the computer system 700 may include instructions to enable execution of the processes and corresponding components shown and described in connection with FIGS. 1A-6.

In alternative embodiments, the machine may be connected (e.g., networked) to other machines in a LAN, an intranet, an extranet, or the Internet. The machine may operate in the capacity of a server machine in a client-server network environment. The machine may be a personal computer (PC), a set-top box (STB), a server, a network router, switch or bridge, or any machine capable of executing a set of instructions (sequential or otherwise) that specify actions to be taken by that machine. Further, while a single machine is illustrated, the term "machine" shall also be taken to include any collection of machines that individually or jointly execute a set (or multiple sets) of instructions to perform any one or more of the methodologies discussed herein.

The example computer system 700 includes a processing device 702 (e.g., processor), a main memory 704 (e.g., read-only memory (ROM), flash memory, dynamic random access memory (DRAM) such as synchronous DRAM (SDRAM)), a static memory 706 (e.g., flash memory, static random access memory (SRAM)), and a data storage device 718, which communicate with each other via a bus 709.

Processing device 702 represents one or more general-purpose processing devices such as a microprocessor, central processing unit, or the like. More particularly, the processing device 702 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processing device 702 may also be one or more special-purpose processing devices such as an application specific integrated circuit (ASIC), a field programmable gate array (FPGA), a digital signal processor (DSP), network processor, or the like. In various implementations of the present disclosure, the processing device 702 is configured to execute instructions for performing the operations and processes described herein.

The computer system 700 may further include a network interface device 708. The computer system 700 also may include a video display unit 710 (e.g., a liquid crystal display (LCD) or a cathode ray tube (CRT)), an alphanumeric input device 712 (e.g., a keyboard), a cursor control device 714 (e.g., a mouse), and a signal generation device 716 (e.g., a speaker).

The data storage device 718 may include a computer-readable storage medium 728 (or machine-readable medium) on which is stored one or more sets of instructions embodying any one or more of the methodologies or functions described herein. The instructions may also reside, completely or at least partially, within the main memory 704 and/or within processing logic 726 of the processing device 702 during execution thereof by the computer system 700, the main memory 704 and the processing device 702 also constituting computer-readable media.

The instructions may further be transmitted or received over a network 701 via the network interface device 708. While the computer-readable storage medium 728 is shown in an example embodiment to be a single medium, the term "non-transitory computer-readable storage medium" should be taken to include a single medium or multiple media (e.g., a centralized or distributed database, and/or associated caches and servers) that store the one or more sets of instructions. The term "non-transitory computer-readable storage medium" shall also be taken to include any medium that is capable of storing, encoding or carrying a set of instructions for execution by the machine and that cause the machine to perform any one or more of the methodologies of the present disclosure. The term "non-transitory computer-readable storage medium" shall accordingly be taken to include, but not be limited to, solid-state memories, optical media, and magnetic media.

The preceding description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely presented as examples. Particular implementations may vary from these example details and still be contemplated to be within the scope of the present disclosure. In the above description, numerous details are set forth.

It will be apparent, however, to one of ordinary skill in the art having the benefit of this disclosure, that embodiments of the disclosure may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to the desired result. The steps are those requiring physical manipulations of physical quantities. Usually, though not necessarily, these quantities take the form of electrical, magnetic, or optical signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "receiving," "transmitting," "causing," "encoding," "decoding," "exchanging," determining," "identifying," "performing," "actuating," "controlling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the disclosure also relate to an apparatus for performing the operations herein. This apparatus may be specially constructed for the required purposes, or it may comprise a general purpose computer selectively activated or reconfigured by a computer program stored in the computer. Such a computer program may be stored in a computer-readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present disclosure as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which such claims are entitled.

What is claimed is:

1. A light emitting fire knife device comprising:

a blade structure comprising a first distal end and a second distal end opposite the first distal end;

a first planar electrical light emitting component disposed on a first planar surface of the blade structure;

a second planar electrical light emitting component disposed on a second planar surface of the blade structure, wherein the second planar surface is opposite the first planar surface;

a handle structure comprising a third distal end and a fourth distal end opposite the third distal end, wherein the third distal end is configured to removably secure to the second distal end of the blade structure; and a first cylindrical electrical light emitting component secured around the handle structure proximate the fourth distal end of the handle structure.

2. The light emitting fire knife device of claim 1, wherein:

the first planar surface forms a first recess and the first planar electrical light emitting component is disposed within the first recess; and the second planar surface forms a second recess and the second planar electrical light emitting component is disposed within the second recess.

3. The light emitting fire knife device of claim 1, wherein:

the second distal end comprises a first electrical connector; and the third distal end comprises a second electrical connector configured to removably connect to and to electrically couple with the first electrical connector.

4. The light emitting fire knife device of claim 1, wherein the blade structure further comprises:

a user interface configured to receive user input; and a processing device configured to control, based on the user input, first illumination of the first planar electrical light emitting component and second illumination of the second planar electrical light emitting component.

5. The light emitting fire knife device of claim 4, wherein the processing device is further configured to control, based on the user input, third illumination of the first cylindrical electrical light emitting component.

6. The light emitting fire knife device of claim 1 further comprising:

a battery disposed within the light emitting fire knife device, wherein the battery is configured to power the first planar electrical light emitting component and the second planar electrical light emitting component; and a charging interface configured to couple to a power source to charge the battery.

7. The light emitting fire knife device of claim 1 further comprising a second cylindrical electrical light emitting component secured around the handle structure proximate the fourth distal end of the handle structure.

8. A fire knife system comprising:

a light emitting fire knife device comprising:

a light emitting blade structure; and a handle structure configured to removably secure to the light emitting blade structure; and a spinning device comprising:

a securing component to removably secure to the handle structure proximate a center of gravity of the light emitting fire knife device;

a rotational component rotatably secured to the securing component; and a handling component secured to the rotational component, wherein the handling component is configured to be secured by a user for spinning of the light emitting fire knife device.

9. The fire knife system of claim 8, wherein the securing component removably clamps onto the handle structure of the light emitting fire knife device.

10. The fire knife system of claim 8, wherein the spinning device is configured to insert through the handle structure of the light emitting fire knife device.

11. The fire knife system of claim 8, wherein the handling component comprises a shaft, wherein a first distal end of the shaft is secured to the rotational component, and wherein a second distal end of the shaft is secured to a gripping device to be secured by the user.

12. The fire knife system of claim 8, wherein the light emitting fire knife device further comprises:

a first planar light emitting component disposed on a first planar surface of the light emitting blade structure; and a second planar light emitting component disposed on a second planar surface of the light emitting blade structure, wherein the first planar surface is opposite the second planar surface.

13. The fire knife system of claim 8, wherein the light emitting fire knife device further comprises a first cylindrical light emitting component secured around the handle structure proximate a distal end of the handle structure.

14. The fire knife system of claim 12, wherein the light emitting fire knife device further comprises a user interface to receive user input to control first illumination of the first planar light emitting component and second illumination of the second planar light emitting component.

15. A method comprising:

receiving user input via a light emitting fire knife device, wherein the light emitting fire knife device comprises a blade structure and a handle structure, wherein the blade structure comprises a first distal end and a second distal end opposite the first distal end, wherein the handle structure comprises a third distal end and a fourth distal end opposite the third distal end, and wherein the third distal end of the handle structure is removably secured to the second distal end of the blade structure; and causing, based on the user input, first illumination of a first planar light emitting component disposed on a first planar surface of the blade structure and second illumination of a second planar light emitting component disposed on a second planar surface of the blade structure, wherein the first planar surface is opposite the second planar surface.

16. The method of claim 15, wherein the receiving of the user input is via a user interface of the blade structure.

17. The method of claim 15 further comprising:

causing, based on the user input, third illumination of a first cylindrical light emitting component secured around the handle structure proximate the fourth distal end of the handle structure.

18. The method of claim 17 further comprising:

causing, based on the user input, fourth illumination of a second cylindrical light emitting component secured around the handle structure proximate the fourth distal end of the handle structure.

19. The method of claim 15, wherein:

the first planar surface forms a first recess and the first planar light emitting component is disposed within the first recess; and the second planar surface forms a second recess and the second planar light emitting component is disposed within the second recess.

20. The method of claim 15, wherein:

the second distal end comprises a first electrical connector; and the third distal end comprises a second electrical connector configured to removably connect to and to electrically couple with the first electrical connector.

* * * * *